US006984010B2

(12) United States Patent
Hosono et al.

(10) Patent No.: US 6,984,010 B2
(45) Date of Patent: Jan. 10, 2006

(54) INK JET RECORDING HEAD, METHOD OF MANUFACTURING THE SAME METHOD OF DRIVING THE SAME, AND INK JET RECORDING APPARATUS INCORPORATING THE SAME

(75) Inventors: Satoru Hosono, Nagano (JP); Tomoaki Takahashi, Nagano (JP); Tomohiro Sayama, Nagano (JP); Tsuyoshi Kitahara, Nagano (JP); Hirofumi Teramae, Nagano (JP); Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/942,764

(22) Filed: Aug. 31, 2001

(65) Prior Publication Data

US 2002/0036669 A1 Mar. 28, 2002

(30) Foreign Application Priority Data

| | | |
|---|---|---|
| Sep. 1, 2000 | (JP) | P.2000-264791 |
| Sep. 1, 2000 | (JP) | P.2000-264792 |
| Sep. 7, 2000 | (JP) | P.2000-271771 |
| Aug. 30, 2001 | (JP) | P.2001-260704 |

(51) Int. Cl.
*B41J 29/393* (2006.01)
*B41J 29/38* (2006.01)

(52) U.S. Cl. ..... 347/19; 347/10

(58) Field of Classification Search ..... 347/10, 347/11, 19; 29/890.01

See application file for complete search history.

(56) References Cited

U.S. PATENT DOCUMENTS

| | | | | |
|---|---|---|---|---|
| 4,631,548 | A * | 12/1986 | Milbrandt | 347/15 |
| 4,704,675 | A * | 11/1987 | Jacobs et al. | 347/14 |
| 4,973,981 | A * | 11/1990 | Bartky et al. | 347/19 |
| 5,049,898 | A * | 9/1991 | Arthur et al. | 347/19 |
| 5,506,611 | A * | 4/1996 | Ujita et al. | 347/86 |
| 5,541,628 | A * | 7/1996 | Chang et al. | 347/10 |
| 6,116,717 | A * | 9/2000 | Anderson et al. | 347/19 |
| 6,224,182 | B1 * | 5/2001 | Nagoshi et al. | 347/19 |

FOREIGN PATENT DOCUMENTS

| | | |
|---|---|---|
| EP | 0 841 164 A1 | 5/1998 |
| EP | 1 023 997 A2 | 8/2000 |
| EP | 1 023 999 A2 | 8/2000 |
| JP | 4-361046 | 12/1992 |
| JP | 5-016359 | 1/1993 |
| JP | 6-008428 | 1/1994 |
| JP | 9-254412 | 9/1997 |
| JP | 9-327908 | 12/1997 |
| JP | 11-058729 | 3/1999 |
| JP | 2000-071440 | 3/2000 |
| WO | WO 97/37852 | 10/1997 |

* cited by examiner

*Primary Examiner*—Thinh Nguyen
(74) *Attorney, Agent, or Firm*—Sughrue Mion, PLLC

(57) ABSTRACT

After assembling an ink jet recording head which includes a plurality of nozzle orifices forming at least one nozzle row, pressure chambers each communicated with the associated nozzle orifice, pressure generating elements each generating pressure fluctuation in ink provided in the associated pressure chamber to eject an ink droplet from the associated nozzle orifice, a natural period of the ink pressure fluctuation in the pressure chamber of the assembled recording head is measured. Then the assembled recording head is classified into a plurality of ranks, based on the measured natural period.

44 Claims, 17 Drawing Sheets

| | | Iw | |
|---|---|---|---|
| Tc RANK ID | 0 | Iw2 > Iw1 < Iw3 | |
| | | Iw2 > Iw1 = Iw3 | |
| | | Iw2 = Iw1 < Iw3 | |
| | 1 | Iw2 < Iw1 < Iw3 | |
| | 2 | Iw2 > Iw1 > Iw3 | |
| | ERROR | Iw2 = Iw1 = Iw3 | |
| | | Iw2 = Iw1 > Iw3 | |
| | | Iw2 < Iw1 = Iw3 | |
| | | Iw2 < Iw1 > Iw3 | |

INK JET RECORDING HEAD, METHOD OF MANUFACTURING THE SAME METHOD OF DRIVING THE SAME, AND INK JET RECORDING APPARATUS INCORPORATING THE SAME

BACKGROUND OF THE INVENTION

The present invention relates to an ink jet recording head that is constructed so that it produces pressure fluctuations in ink in the pressure chamber by operations of a pressure generating element and ejects ink droplets through a nozzle orifice, a method for manufacturing the recording head, a method for driving the recording head, and an ink jet recording apparatus incorporating the recording head.

There are various types of ink jet recording heads that are used for an ink jet recording apparatus of a printer, plotter, etc., for example, types in which a piezoelectric vibrator or a heating element is used as a pressure generating element.

For example, in a recording head employing a piezoelectric vibrator, the ink pressure in the pressure chamber is varied by deforming a resilient plate, which partially sections the pressure chamber, through use of the piezoelectric vibrator, and ink droplets are ejected through the nozzle orifice by fluctuations in the ink pressure. Further, in a recording head employing a heating element, the heating element is provided in the pressure chamber, wherein ink is boiled by radically heating the heating element to cause air bubbles to be generated in the pressure chamber. And, the ink in the pressure chamber is pressurized by the air bubbles, and ink droplets are ejected through the nozzle orifice.

That is, either of these recording heads ejects ink droplets by varying the ink pressure in the pressure chamber.

In these types of recording heads, pressure vibrations are excited in the ink in the pressure chamber as if the inside of the pressure chamber operates like an acoustic tube in accordance with fluctuations in the ink pressure.

For example, in the recording head employing the piezoelectric vibrator, pressure vibrations having a natural period are excited, which is mainly determined by the thickness and/or area of the resilient plate, shape of the pressure chamber, compressibility of the ink, etc. Further, in the recording head employing the heating element, pressure vibrations having a natural period are excited, which is mainly determined by the shape of the pressure chamber, compressibility of the ink, etc.

And, in these types of recording heads, the ejection timing of ink droplets is established by the natural period of ink, and the recording heads are constructed so that the eject of ink droplets can be efficiently carried out.

However, in these types of recording heads, remarkably minute processing and assembling at the micrometer level ($\mu$m) are carried out. Therefore, the thickness and/or area of the resilient plate, shape of the pressure chamber, size of the nozzle orifice, etc., may change in respective recording heads, whereby the natural period of ink in the pressure chamber may vary. Therefore, if all the recording heads are driven by a drive signal having the same waveform, the eject characteristics of ink droplets may also vary in compliance with the unevenness of the natural period.

For example, as the natural period is deviated from the designed criterion (tolerance), the meniscus after ink droplets are ejected, that is, suppression of the vibration of the free surface of the ink, which is exposed at the nozzle orifice, becomes insufficient, and is not stabilized. In addition, an external force applied to the ink by operations of the pressure generating element is counterbalanced by the pressure vibrations in the ink.

For this reason, the amount of ink droplets that are subsequently ejected, (that is, the amount of ink), and the flying speed of ink droplets, (that is, the ink velocity), varies in respective recording heads.

As a result, there arises a problem in that the quality of recorded images becomes uneven in respective recording heads. Further, a recording head whose eject characteristics are greatly deviated from the designed criterion should be abolished, thereby reducing the yield ratio thereof.

In addition, it is considered that the natural period of ink in the pressure chamber is measured in respective assembled recording heads, and an attempt is made to make the image quality uniform by varying the waveform of the drive signal in response to the measured natural period. However, if a separate or independent waveform is established in respective recording heads, the cost of production will be worsened, wherein it would become difficult to carry out mass production in view of time and cost, etc.

SUMMARY OF THE INVENTION

The present invention was developed in view of these and other problems and situations. It is therefore an object of the invention to provide a method for manufacturing an ink jet recording head that is suitable for mass production, and to provide such an ink jet recording head. Further, it is another object of the invention to provide a method for driving the recording head, by which the meniscus vibration can be efficiently suppressed even if the natural period of ink in the pressure chamber varies, the eject characteristics of ink droplets can be optimized, and which is suitable for mass production, and to provide an ink jet recording apparatus therefor.

In order to achieve the above object, according to the invention, there is provided a method of manufacturing an ink jet recording head which includes a plurality of nozzle orifices forming at least one nozzle row, pressure chambers each communicated with the associated nozzle orifice, pressure generating elements each generating pressure fluctuation in ink provided in the associated pressure chamber to eject an ink droplet from the associated nozzle orifice, the method comprising the steps of:

assembling the ink jet recording head;

measuring a natural period of the ink pressure fluctuation in the pressure chamber of the assembled recording head; and classifying the assembled recording head into a plurality of ranks, based on the measured natural period.

In this configuration, since a waveform profile of the drive signal can be set on the basis of the rank given in each of the recording heads when using a certain recording head, the setting work can be facilitated, and this is suitable for mass production. In this case, since no separately exclusive waveform as per recording head is used, efficiency is satisfactory. Furthermore, it is possible to correct individual differences of the recording heads in the process of manufacturing, wherein the production yield is increased.

Preferably, the measuring step includes the steps of:

supplying an evaluation signal including at least an excitation element which excites the ink pressure fluctuation, and an ejection element which follows the excitation element to eject the ink droplet from the nozzle orifice;

measuring an ejected amount of the ink droplet at plural times while varying a time period between a termination end of the excitation element and an initial end of the ejection element; and identifying the natural period based on a correlation between the time period and the measured ink amount.

In this configuration since it is possible to measure the natural period on the basis of the ejected amount of ink that changes in response to the time duration from the excitation element to the election element, the identification or judgment can be made simple, and it is possible to easily cope with automation of the measurement Accordingly, it is possible to classify the recording heads without sacrificing production efficiency, and this is suitable for mass production.

Alternatively, the measuring step includes the steps of:

supplying an evaluation signal including at least an excitation element which excites the ink pressure fluctuation, and an ejection element which follows the excitation element to eject the ink droplet from the nozzle orifice;

measuring an ejected speed of the ink droplet at plural times while varying a time period between a termination end of the excitation element and an initial end of the ejection element; and identifying the natural period based on a correlation between the time period and the measured ejection speed.

Also in this configuration, the identification or judgment can be made simple, and it is possible to easily cope with automation of the measurement. Accordingly, it is possible to classify the recording heads without sacrificing the production efficiency, and this is suitable for mass production.

Here, it is preferable that the time interval includes at least:

a first time period which is determined such that the ejected ink amount becomes minimum when the natural period is as per a designed criterion;

a second time period which is shorter than the first time period; and a third time period which is longer than the first time period.

In this configuration, it is possible to more clearly recognize whether a recording head to be measured has a natural period as per the designed criterion, it has a shorter natural period than the designed criterion or it has a longer natural period than the designed criterion.

Preferably, duration of the excitation element is equal to the natural period as per the designed criterion or less.

In this configuration, it is possible to efficiently excite the pressure fluctuation in the measuring step, wherein the reliability of the measurement is improved.

Here, it is preferable that the duration of the excitation element is equal to one half of the natural period as per the designed criterion or less.

Preferably, the plurality of ranks includes at least a first rank which indicates the measured natural period is as per a designed criterion, a second rank which indicates the measured natural period is shorter than the designed criterion, and a third rank which indicates the measured natural period is longer than the designed criterion.

Preferably, the method further comprises the step of indicating the classified rank on the assembled recording head.

In this configuration, it is possible to easily correct unevenness in image quality in each of the recording heads.

Here, it is preferable that the classified rank is indicated by a symbol.

Alternatively, it is preferable that the rank is determined with regard to the respective nozzle rows. Here, the rank is indicted by a symbol which indicates a combination of the classified ranks of the respective nozzle rows.

Alternatively, the classified rank is indicated by coded information which is readable by an optical reader.

Preferably, the method further comprises the steps of; providing a memory; and storing electrically information indicating the classified rank in the memory.

In this configuration, it is possible to easily correct unevenness in image quality in each of the recording heads. Still further, by electrically connecting the memory for storing identifying information to a recording apparatus, it is possible to automate the reading of the rank identifying information.

According to the present invention, there is also provided an ink jet recording head manufactured by the above methods.

Here, it is preferable that the pressure generating element is a piezoelectric vibrator.

Alternatively, the pressure generating element is a heating element, According to the present invention, there is also provided a method of driving the ink jet recording head manufactured by the above method, comprising the steps of:

providing a drive signal including at least one wave element having a control factor which is defined in accordance with the classified rank; and supplying the drive signal to the pressure generating element.

In this configuration, it is possible to establish the waveform profile, etc., of the drive signal in accordance with the rank and that contributes to optimization of the waveform profiles. Unevenness in image quality can be easily corrected in each of the recording heads. Still further, in this case, since no separately exclusive waveform is used in respective recording heads, efficiency is improved, and individual differences in the recording heads can be corrected in the process of manufacturing, wherein the production yield can be further improved. Therefore, this is suitable for mass production.

Preferably, the drive signal is provided with an ejection element which ejects an ink droplet from the nozzle orifice and a damping element which follows the ejection element to damp vibration of a meniscus of the ink in the nozzle orifice. Here, a control factor of the damping element is defined in the drive signal provision step.

In this configuration, it is possible to control the vibrations of the meniscus in accordance with the ranks, wherein it is possible to efficiently suppress the vibration of the meniscus.

Alternatively, the drive signal is provided with a characteristics changing element which changes election characteristics of the ink droplet Here, a control factor of the characteristics changing element is defined in the drive signal provision step.

In this configuration, it Is possible to control the ejection characteristics of ink droplets in accordance with the ranks, wherein it is possible to optimize the ejection characteristics.

Preferably, the plurality of ranks includes at least a first rank which indicates the measured natural period is as per a designed criterion, a second rank which indicates the measured natural period is shorter than the designed criterion, and a third rank which indicates the measured natural period is longer than the designed criterion.

According to the present invention, there is also provided an ink jet recording apparatus, comprising:

an ink jet recording head, manufactured by the above method; and a waveform controller, which provides a drive signal including at least one wave element having a control factor which is defined in accordance with the classified rank.

Preferably, the drive signal is provided with an ejection element which ejects an ink droplet from the nozzle orifice and a damping element which follows the ejection element to damp vibration of a meniscus of the ink in the nozzle orifice. Here, the waveform controller defines a control factor of the damping element.

Alternatively, the drive signal is provided with a first drive pulse including:

a first expansion element, which expands the pressure chamber such an extent that an ink droplet is not ejected from the nozzle orifice;

a first ejection element, which follows the first expansion element to contract the pressure chamber to eject an ink droplet from the nozzle orifice;

a holding element, which follows the first ejection element to hold the contracted state of the pressure chamber for a predetermined duration; and a first damping element, which follows the holding element to expand the pressure chamber to damp vibration of a meniscus of the ink in the nozzle orifice.

Here, the waveform controller defines the duration of the holding element.

Alternatively, the drive signal is provided with a second drive pulse including:

a second expansion element, which expands the pressure chamber to pull a meniscus of ink in the nozzle orifice toward the pressure chamber;

a second ejection element, which follows the second expansion element to contract the pressure chamber to eject a center portion of the meniscus as an ink droplet; and a second damping element, which follows the second ejection element to expand the pressure chamber to damp vibration of the meniscus.

Here, the waveform controller defines the duration of the second damping element.

Alternatively, the drive signal is provided with a third drive pulse including:

an ejection pulse, which ejects an ink droplet from the nozzle orifice;

a damping pulse, which follows the ejection pulse to damp vibration of a meniscus of ink in the nozzle orifice; and a first connecting element, which connects a termination end of the ejection pulse and an initial end of the damping pulse.

Here, the waveform controller defines duration of the connecting element.

Alternatively, the drive signal is provided with a plurality of drive pulses for driving the pressure generating element and a second connecting element which connects a termination end of a preceding drive pulse and an initial end of a subsequent drive pulse.

Here, the waveform controller defines duration of the second. connecting element.

Alternatively, the drive signal is provided with a characteristics changing element which changes ejection characteristics of an ink droplet.

Here, the waveform controller defines a control factor of the characteristics changing element.

Here, it is preferable that the drive signal is provided with a fourth drive pulse including:

a first expansion element, which expands the pressure chamber such an extent that an ink droplet is not ejected; and a first ejection element, which follows the first expansion element to contract the pressure chamber to eject an ink droplet from the nozzle orifice.

Here, duration of at least one of the first expansion element and the first ejection element is defined by the waveform controller.

Alternatively, a potential difference between an initial end and a termination end of at least one of the first expansion element and the first ejection element is defined by the waveform controller.

Alternatively, the drive signal is provided with a fifth drive pulse including:

a first expansion element, which expands the pressure chamber such an extent that an ink droplet is not ejected;

a first holding element, which follows the first expansion element to hold the expanded state of the pressure chamber; and a first ejection element, which follows the first expansion element to contract the pressure chamber to eject an ink droplet from the nozzle orifice, Here, the waveform controller defines duration of the first holding element.

Alternatively, the drive signal is provided with a sixth pulse including:

second expansion element, which expands the pressure chamber to pull a meniscus of ink in the nozzle orifice toward the pressure chamber; and a second ejection element, which follows the second expansion element to contract the pressure chamber to eject a center portion of the meniscus as an ink droplet.

Here, duration of at least one of the second expansion element and the second ejection element is defined by the waveform controller.

Alternatively, a potential difference between an initial end and a termination end of at least one of the second expansion element and the second ejection element is defined by the waveform controller.

Alternatively, the drive signal is provided with a seventh pulse including:

a second expansion element which expands the pressure chamber to pull a meniscus of ink in the nozzle orifice toward the pressure chamber, a second holding element, which follows the second expansion element to hold the expanded state of the pressure chamber; and a second ejection element, which follows the second holding element to contract the pressure chamber to eject a center portion of the meniscus as an ink droplet.

Here, the waveform controller defines duration of the second holding element.

Preferably, the recording apparatus further comprises: a memory, which electrically stores information indicating the classified rank. The memory is electrically connected to the waveform controller.

Preferably, the recording apparatus further comprises:

a rank indicator, provided with the recording head to indicate the classified rank thereof so as to be optically readable; and an optical reader, which optically reads the classified rank indicated by the rank indicator.

Here, the waveform controller acquires the classified rank read by the optical reader.

Preferably, the pressure generating element is a piezoelectric vibrator.

Alternatively, the pressure generating element is a heating element,

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
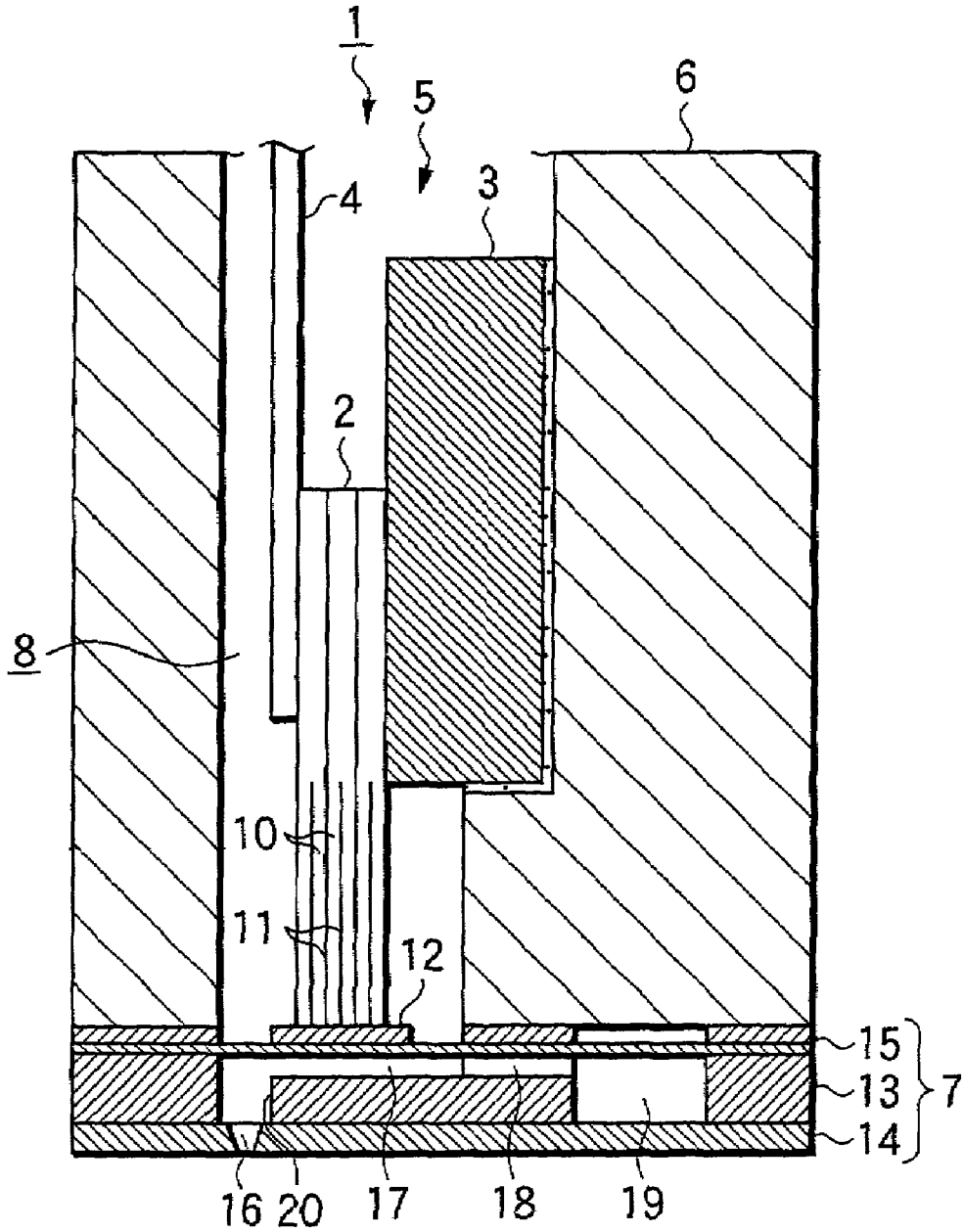
FIG. 1 is a crosssectional view of a recording head provided with a piezoelectric vibrator.

Hereinafter, a description is given of embodiments of the present invention with reference to the accompanying drawings. First, a description is given of the structure of an ink jet recording head (hereinafter called a "recording head"). As shown in FIG. 1, the illustrated recording head 1 is provided with a vibrator unit 5 in which a plurality of piezoelectric vibrators 2, stationary plate 3, and flexible cable 4, etc., are incorporated as a unit; a casing 6 capable of accommodating the vibrator unit 5; and a channel unit 7 that is connected to the tip end face of the casing 6.

The casing 6 is a resin-made block-like member in which an accommodation vacancy 8 that is open at both the ends thereof is formed, and the vibrator unit 5 is accommodated and fixed in the accommodation vacancy 8. The vibrator unit 5 is accommodated in a state where the tip end face of the piezoelectric vibrator 2 is faced to the opening at the tip end of the accommodation vacancy 8, wherein the stationary plate 3 is adhered to the inner wall face that sections the accommodation vacancy 8.

The piezoelectric vibrator 2 is a type of electromechanical converting element and is like a comb which is longitudinally slender. In the present embodiment, the piezoelectric vibrator 2 is divided at remarkably minute widths ranging from 30 $\mu$m through 100 $\mu$m. And, the piezoelectric vibrator 2 is a lamination type piezoelectric vibrator in which a piezoelectic body 10 and internal electrodes 11 are alternately laminated, and the vibrator is a longitudinal-effect (d33 effect) type piezoelectric vibrator that is flexible in its longitudinal direction orthogonal to the direction of the electric field, in other words, oscillatable in the longitudinal direction of the element.

Respective piezoelectric vibrators 2 are such that the base end side portions thereof are connected onto the stationary plate 3, and are mounted in a cantilevered manner wherein the free ends of the piezoelectric vibrators 2 are projected from the edge of the stationary plate 3. And, the tip end faces of the respective piezoelectric vibrators 2 are brought into contact with and fixed at the island portion 12 of the respective channel units 7. In addition, the flexible cable 4 is electrically connected to the respective piezoelectric vibrators 2 at the base end side of the vibrators, which become the opposite side of the stationary plate 3.

Figure 2:
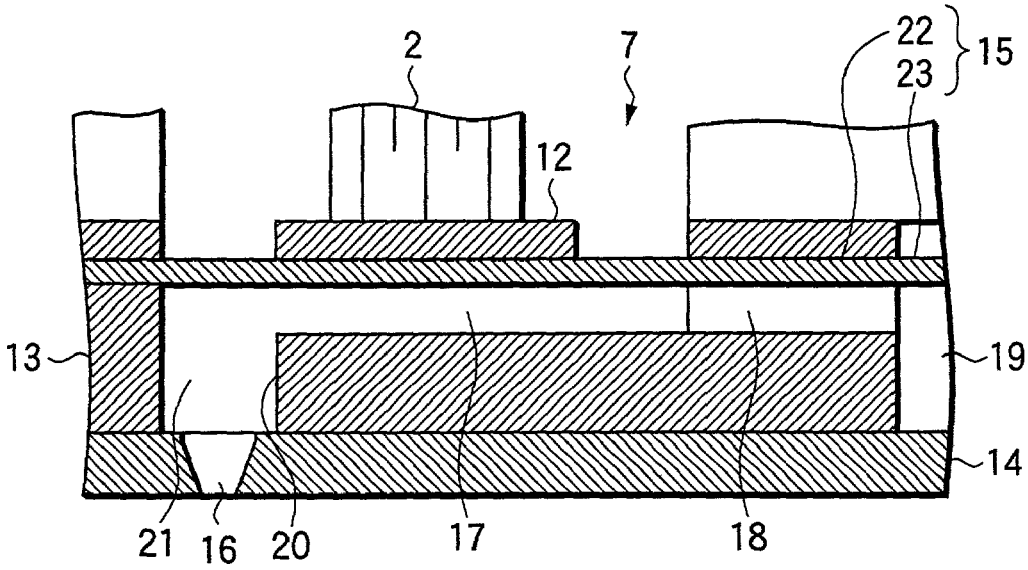
FIG. 2 is a partially enlarged view showing a channel unit in the recording head in FIG. 1.

The channel unit 7 is constructed, as shown in FIG. 2, so that a nozzle plate 14 and a resilient plate 15 are laminated with the channel forming substrate 13 placed therebetween in such a manner that the nozzle plate 14 is disposed on one face of the channel forming substrate 13 and the resilient plate 15 is disposed on the other face which becomes the opposite side of the nozzle plate 14.

The nozzle plate 14 is a thin plate made of stainless steel, in which a plurality of nozzle orifices 16 are disposed like a line at a pitch corresponding to the dot-formed density. In the embodiment, 96 nozzle orifices 16 are provided at a pitch of 180 dpi (dots per inch), and these nozzle orifices 16 constitute a nozzle row. And, a plurality of nozzle rows are formed so as to correspond to the type (for example, color) of ink that can be ejected.

A channel forming substrate 13 is a plate-like member in which a plurality of vacant portions becoming a pressure chamber 17 are formed so as to correspond to the respective nozzle orifices 16 of the nozzle plate 14 in a state where the vacant portions are sectioned by partitions, and at the same time, vacant portions that become an ink supply port 18 and a common ink reservoir 19 are formed. The channel forming substrate 13 is prepared by etching, for example, a silicon wafer. The pressure chamber 17 is a chamber that is slender in the direction orthogonal to the line direction (nozzle row direction) of the nozzle orifices 16, and is composed of a flat-like recess chamber sectioned by a weir portion 20. And, the ink supply port 18 is formed by the weir portion 20 in the form of a narrowed portion that is narrower than the channel width. Further, a nozzle communicating port 21 that causes the nozzle orifices 16 to communicate with pressure chamber 17 is provided so as to be penetrated in the plate thickness direction at the position extremely apart from the common ink reservoir 19 in the pressure chamber 17.

The resilient plate 15 is a double structure in which a resin film 23 made of PPS (polyphenylene sulfide), etc., is laminated on a stainless steel plate 22. Further, the resilient plate 15 concurrently acts as a diaphragm portion that seals one opening face of the pressure chamber 17 and a compliance portion that seals one opening face of the common ink reservoir 19. In addition, the island portion 12 is formed by annularly etching the stainless steel plate 22 at the portion, which serves as the diaphragm portion, that is, the portion corresponding to the pressure chamber 17. Further, only the resin film 23 is caused to remain by removing through etching the stainless steel plate 22 at the portion that serves as the compliance portion, that is, the portion corresponding to the common ink reservoir 19.

In the recording head 1 having the above-described construction, the island portion 12 is pressed to the nozzle plate 14 side by causing the piezoelectric vibrator 2 to extend in the longitudinal direction of the vibrator by ejecting the same. By pressing, the resin film 23 that constitutes the diaphragm portion is deformed to cause the pressure chamber 17 to contract. Further, if the piezoelectric vibrator 2 is caused to contract in the longitudinal direction of the vibrator by charging the same, the pressure chamber 17 is expanded by the resiliency of the resin film 23.

In addition, since the ink pressure inside the pressure chamber 17 varies due to the expansion and contraction thereof, ink droplets can be ejected through the nozzle orifices 16 by controlling the expansion and contraction of the pressure chamber 17.

Next, a description is given of a method for manufacturing the recording head 1. The recording head 1 is produced by the steps of assembling respective components (such as the vibrator unit 5, the casing 6 and the channel unit 7), measuring the natural period Tc of the ink pressure in the pressure chamber 17, which varies due to the assembling precision, dimension precision of parts, etc., with respect to an assembled recording head 1, and classifying the after-measurement recording heads 1 rank by rank on the basis of the natural period Tc obtained in the measuring step.

In the present embodiment, it is measured in the measuring step whether the assembled recording head 1 has a natural period Tc as per the designed criterion (center value), has a shorter natural period Tc than the designed criterion, or has a longer natural period Tc than the designed criterion. Further, the classifying step classifies the recording head 1 into three levels on the basis of the viewpoints of the natural period Tc being as per the designed criterion, shorter than the designed criterion or longer than the designed criterion.

Hereinafter, a description is given of the respective steps.

In the above-described assembling step, a channel unit 7 is prepared. That is, a nozzle plate 14, a channel forming substrate 13, and a resilient plate 15 are laminated and integrated. After that, a casing 6 is adhered to the face at the resilient plate 15 side of the channel unit 7. The adhering may be performed by using, for example, an adhesive.

After the channel unit 7 is connected to the casing 6, a vibrator unit 5 that is separately prepared is accommodated in the accommodation vacancy 8 of the casing 6 and adhered thereto. That is, the vibrator unit 5 is moved while being supported by a fixture, and is inserted into the accommodation vacancy 8. And, the piezoelectric vibrator 2 is positioned in a state where the tip end face thereof is brought into contact with the island portion 12 of the resilient plate 15. After it is positioned, an adhesive is supplied between the rear side of the stationary plate 3 and the inner wall of the casing 6 in the positioned state, thereby adhering the vibrator unit 5.

Figure 3:
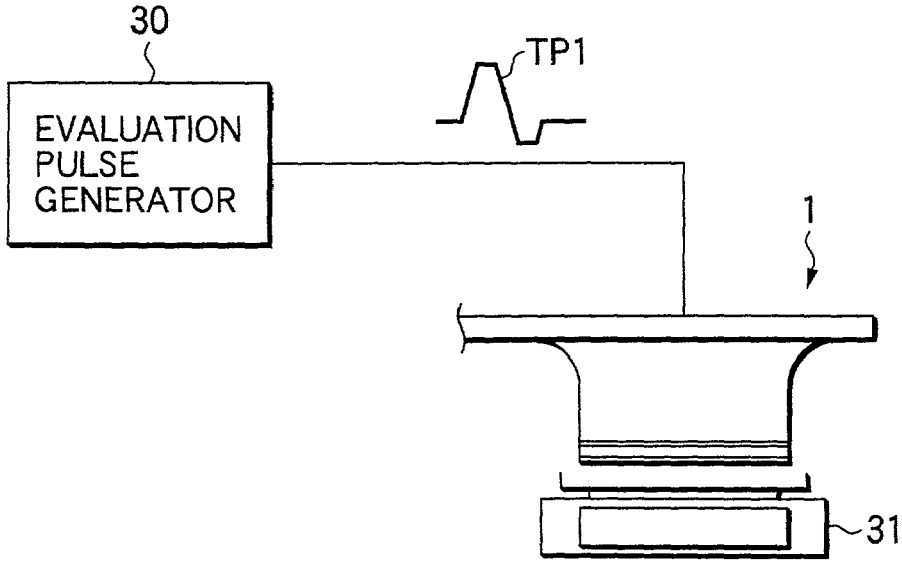
FIG. 3 is a view explaining a device employed in a measuring step.

The measuring step is carried out, as shown in FIG. 3, by using an evaluation pulse generator 30 and an electronic balance 31, which serves as an ink amount measure. In the embodiment, the evaluation pulse generator 30 is electrically connected to the recording head 1, and an evaluation pulse TP1 (an evaluation signal) that is generated by the evaluation pulse generator 30 is supplied to the piezoelectric vibrator 2, whereby ink droplets are ejected from the recording head. And, the weight of the ejected ink droplets is measured by the electronic balance 31 (an ink amount measuring step) Then, the natural period Tc of ink In the pressure chamber 17 is identified on the basis of the measured ink weight (a first period identifying step).

Figure 4:
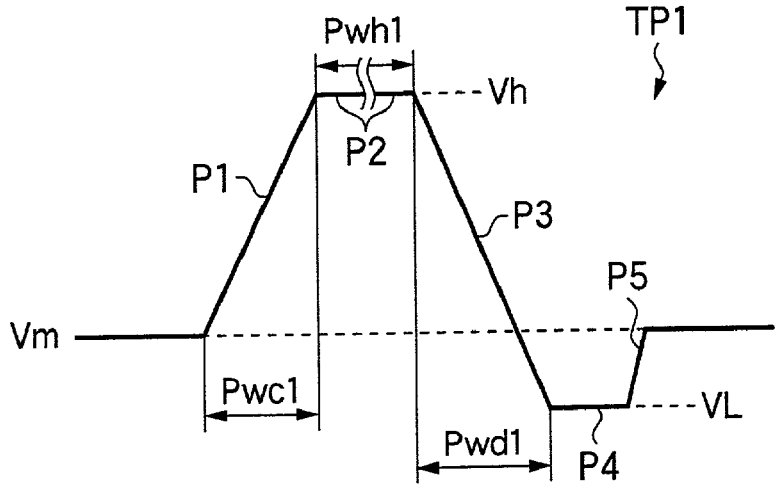
FIG. 4 is a view explaining an evaluation pulse that is generated from an evaluation pulse generator.

The evaluation pulse generator 30 generates, for example, an evaluation pulse TP1 shown in, for example, FIG. 4. The evaluation pulse TP1 includes an excitation element P1 that boosts potential at a fixed gradient from the intermediate potential Vm serving as a reference potential to the maximum potential Vh, a first holding element P2, which is generated continuously from the excitation element P1, for holding the maximum potential Vh, an ejection element P3, which is generated continuously from the first holding element P2, for decreasing the potential from the maximum potential Vh to the minimum potential VL and thereby for ejecting ink droplets through the nozzle orifices 16, a second holding element P4, which is generated continuously from the ejection element P3, for holding the minimum potential VL, and a damping element P5 for boosting the potential from the minimum potential VL to the intermediate potential Vm at a fixed gradient.

Figure 5:
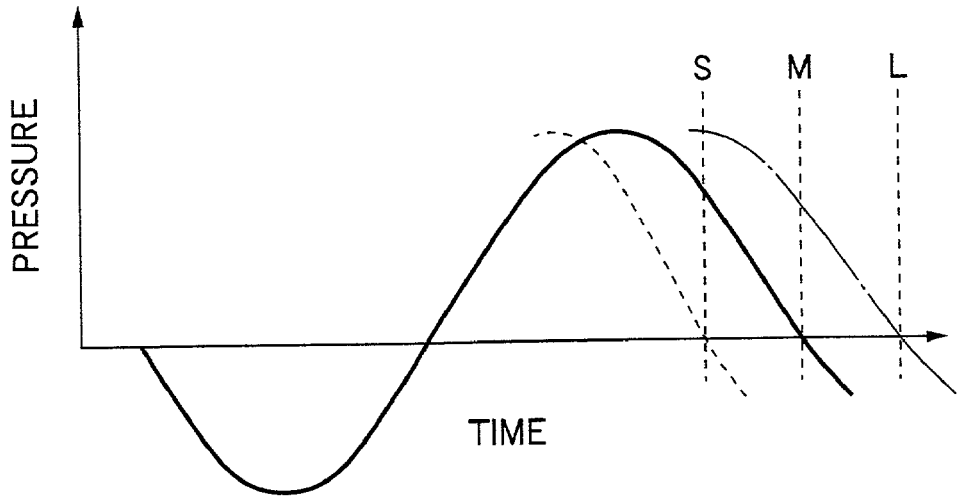
FIG. 5 is a view explaining pressure fluctuations of ink in a pressure chamber when an excitation element is provided.

The excitation element P1 is an element for exciting pressure vibrations for ink in the pressure chamber 17. As the excitation element P1 is supplied to the piezoelectric vibrator 2, that is, as the excitation element P1 is supplied to maintain the maximum potential Vh, the ink pressure in the pressure chamber 17 varies as shown in FIG. 5. That is, the pressure chamber 17 is expanded by supply of the excitation element P1, wherein the ink pressure is made lower than in the stationary state. After that, the ink pressure becomes higher than in the stationary state due to a reaction, etc., of the resin film 23 that constitutes the diaphragm portion. Thereafter, the ink pressure becomes lower than in the stationary state. That is, pressure vibrations of the above-described natural period Tc are excited for the ink in the pressure chamber 17 due to the supply of the excitation element P1.

The time Pwc1 of generation of the excitation element P1, that is, the time of supply to the piezoelectric vibrator 2, is set to the time at which the pressure vibrations of the natural period Tc can be excited. And, in view of the object of efficiently exciting the pressure vibrations, it is preferable that the time Pwc1 is set to the designed criterion or less of the natural period Tc of the ink in the pressure chamber 17, and it is further preferable that the time Pwc1 is set to one half or less the designed criterion.

The ejection element P3 is an element that pressurizes the ink by causing the pressure chamber 17 to contract and ejects ink droplets through the nozzle orifices 16. The time Pwd1 of generation of the ejection element P3 is set to the time at which pressure necessary to eject ink droplets can be obtained. The time Pwd1 is preferably set to one half or less the designed criterion of the natural period Tc.

The first holding element P2 is an element that defines the supply starting timing of the ejection element P3, in other words, the interval from the termination end of the excitation element P1 to the beginning end of the ejection element P3. And, in the step of measuring the ink amount, a plurality of generation times Pwh1 are established. That is, a plurality of types of evaluation pulses TP1, in which the time Pwh1 of generation of the first holding element P2 differs, are used, and measurements of the amount of ink are carried out several times.

In the present embodiment, the amount of ink is measured three times, by using a first evaluation pulse in which the time Pwh1 of generation is set to a first reference time that becomes the reference, a second evaluation pulse in which the time Pwh1 of generation is set to a second reference time that is shorter than the first reference time, and a third evaluation pulse in which the time Pwh1 of generation is set to a third reference time that is longer than the first reference time.

Herein, the first reference time is set to the time at which the ejecting amount of ink is minimized where the assembled recording head 1 has the natural period Tc as per the designed criterion. For example, the first reference time is set to the time at which the sum of the first reference time and the time of Pwc1 of the excitation element P1 enters in the scope of ±10% of the designed criterion of the natural period Tc. Further, the second reference time is set to the time which is shorter by a predetermined duration of time than the first reference time, and the third reference time is set to the time which is longer by a predetermined duration of time than the first reference time.

Figures 6, 7:
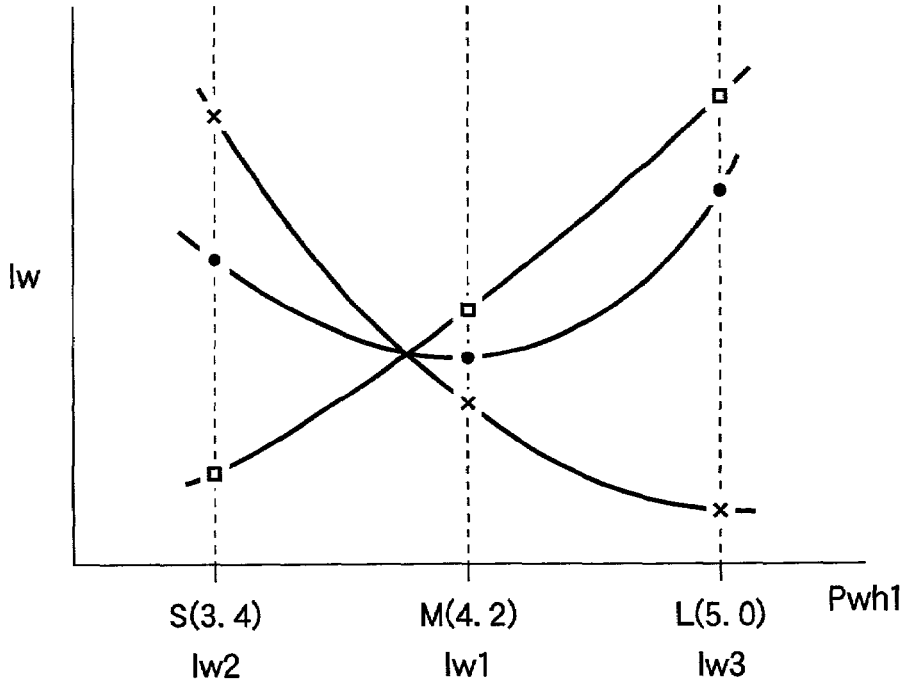
FIG. 6 is a view explaining the correlation between the time Pwh1 of generation of the first holding element and the amount of ink.
FIG. 7 is a view explaining the relationship between the amount of ink and Tc rank ID in each of the times Pwh1 of generation.

Speaking in detail, where it is assumed that the designed criterion of the natural period Tc is approx 8.4 μs (microseconds) and the time of Pwc1 of generation of the excitation element P1 is 4.2 μs, as shown in FIG. 6, the first reference time (M) is set to 4.2 μs, the second reference time (S) is set to 3.4 μs which is shorter by 0.8 μs than the first reference time, and the third reference time (L) is 5.0 μs which is longer by 0.8 μs than the first reference time And, in the step of measuring the amount of ink, the three types of evaluation pulses TP1 defined as described above are provided to the piezoelectric vibrator 2. As such evaluation pulses TP1 is supplied to the piezoelectric vibrator 2, the pressure chamber 17 is expanded in accordance with the supply of the excitation element P1 to cause pressure vibrations to be excited for the ink in the pressure chamber 17. Subsequently, the expanded state of the pressure chamber 17 is maintained for the entire time period of supply of the first holding element P2, and the pressure chamber 17 is caused to contract in accordance with the supply of the ejection element P3, wherein ink droplets are ejected through the nozzle orifices 16. The ink droplets thus ejected are caught and collected, whereby the collected amount of ink is measured by using the electronic balance 31 with regard to the respective evaluation pulses TP1.

Furthermore, although, for the measurement of the amount of ink, the electronic balance 31 is employed in view of securing the precision and automation of the measurement, the measure is not limited to such an electronic balance as long as the amount of ink can be measured.

In the step of measuring the amount of ink, the ejected amount of ink differs in respective evaluation pulses TP1. For example, if the first evaluation pulse is used in the case where the assembled recording head 1 has the natural period Tc as per the designed criterion, the ejection element P3 is provided at the timing shown with a symbol M in FIG. 5. In this case, since the compression force of the ink by the ejection element P3 is counterbalanced by the pressure vibrations of the ink excited by the excitation element P1, the ejected amount of ink is reduced to the minimum. Further, if the second evaluation pulse is used, the ejection element P3 is provided at the timing shown by a symbol S in FIG. 5, and if the third evaluation pulse is used, the ejection element P3 is provided at the timing shown by a symbol L in FIG. 5. In these cases, since Ink can be more efficiently pressurized than in the case of having used the first evaluation pulse, the amount of ink is further increased than in the case where the first evaluation pulse is used.

Further, in the case where the assembled recording head 1 has a shorter natural period Tc than the designed criterion, as shown by a broken line in FIG. 5, the time period for providing the first holding element P2, in which the ejected amount of ink is minimized, is made shorter than that of the recording head 1 having the natural period Tc as per the designed criterion. Therefore, the amount of ink is reduced to the minimum in the case where the second evaluation pulse is used, it is reduced to the second least in the case where the first evaluation pulse is used, and the amount of ink is increased to the maximum in the case where the third evaluation pulse is used.

To the contrary, in the case where the assembled recording head 1 has a longer natural period Tc than the designed criterion, as shown by a chain line in FIG. 5, the time period of providing the first holding element P2, in which the ejected amount of ink is reduced to the minimum, is made longer than in the recording head 1 having the natural period Tc as per the designed criterion. Therefore, the amount of ink is maximized in the case where the second evaluation pulse is used; it is increased to the second most in the case where the first evaluation pulse is used, and the amount of ink is the least in the case where the third evaluation pulse is used.

And, the step of identifying the first cycle identifies the natural period of the ink pressure in the pressure chamber 17 on the basis of the amount of ink of the respective evaluation pulses TP1. For example, as shown in FIG. 6, the weight Iw1 of ink corresponding to the first evaluation pulse (Pwh1=4.2 μs), the weight Iw2 of ink corresponding to the second evaluation pulse (Pwh1=3.4 μs), and the weight Iw3 of ink corresponding to the third evaluation pulse (Pwh1=5.0 μs) are compared with each other, that is, on the basis of the correlation between the time duration from the excitation element P1 to the ejection element P3 and the weights of ink, the natural period Tc is identified.

That is, in the case where a recording head 1 is used, which has such a relationship that the weight Iw1 of ink is the least and the amounts Iw2 and Iw3 of ink are larger than the weight Iw1 of ink when these amounts Iw1, Iw2 and Iw3 of ink are compared with each other, (in the case where the relationship among the amounts of ink is as shown by a line segment marked with circles in FIG. 6), it is identified that the natural period Tc of the assembled recording head Tc is as per the designed criterion. Further, in the embodiment, it is identified that the natural periods Tc are as per the designed criterion with respect to the recording head 1 for which the amounts Iw1 and Iw2 of ink are roughly equal to each other and the weight Iw3 of ink is greater than the weight Iw1 of ink, and the recording head 1 for which the amounts Iw1 and 1w3 of ink are roughly equal to each other and the weight tw2 of ink is greater than the weight Iw1 of ink.

In addition, in the case of the recording head 1 having such a relationship that the weight Iw2 of ink is the least, the weight Iw1 of ink is the second least and the weight Iw3 of ink is the maximum (that is, in the case where the relationship is as shown by a line segment marked with squares in FIG. 6), it is identified that the natural period Tc of the assembled recording head 1 is shorter than the designed criterion.

In the case of the recording head 1 having such a relationship that the weight Iw2 of ink is the maximum, the weight Iw1 of ink is the second maximum, and the weight Iw3 of ink is the least (that is, in the case where the relationship is as shown by a line segment marked with crosses in FIG. 6), it is identified that the natural period Tc of the assembled recording head 1 is longer than the designed criterion.

If any pattern other than the above description is obtained, it is handled as an error, wherein another process that urges the measurement again is carried out.

Thus, in the present embodiment, since ink droplets are ejected by using three types of evaluation pulses TP1 in which the time duration from the excitation element P1 to the ejection element P3 differs, and the natural period Tc is identified based on the correlation between the respective evaluation pulses TP1 and the amounts Iw1 through Iw3 of ink, the identification work is facilitated, and it becomes easy to cope with automation of the measurement.

The rank classifying steps classify the recording head 1 into three stages of the Tc rank on the basis of the results of the identification in the first cycle identification step of the measurement process. That is, as shown in FIG. 7, in the case where the natural period Tc is as per the designed criterion, the Tc rank is classified to a reference (default) rank; wherein the Tc rank ID is 0. Further, in the case where the natural period Tc is shorter than the designed criterion, the Tc rank is classified to a minimum rank, wherein the Tc rank ID is given 1, and in the case where the natural period Tc is longer than the designed criterion, the Tc rank is classified to a maximum rank, wherein the Tc rank is given 2.

Figure 8:
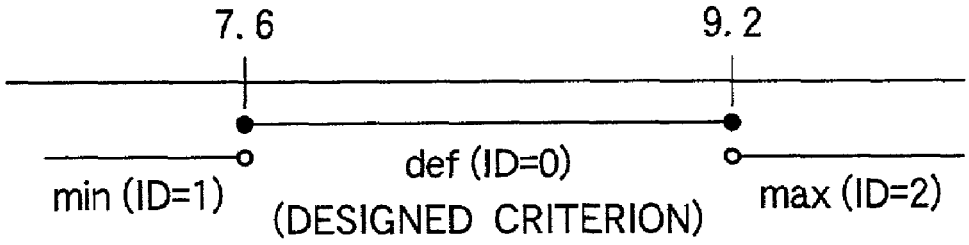
FIG. 8 is an exemplary view explaining the relationship between the Tc rank ID and natural period Tc.

And, in the present embodiment, since the designed criterion of the natural period Tc is approx 8.4 μs, as shown in FIG. 8, the recording heads 1 whose natural period Tc of ink in the pressure chamber 17 is from 7.6 μs or more to 9.2 μs or less are classified to the reference rank, recording heads 1 whose natural period Tc is less than 7.6 μs are classified to the minimum rank, and recording heads 1 whose natural period Tc is more than 9.2 μs are classified to the maximum rank.

Thus, in the method for manufacturing a recording head according to the present embodiment, since the reference rank in which the natural period Tc is as per the designed criterion, minimum rank in which the natural period Tc is shorter than the designed criterion Tc, and maximum rank in which the natural period Tc is longer than the designed criterion are set as the Tc ranks, and the assembled recording heads 1 are classified in these three Tc ranks, it is possible to set the recording drive waveforms for the respective Tc ranks as described later, wherein uniformizing of image quality can be facilitated.

Further, since the natural period Tc is identified by the correlation. between the time duration from the excitation element P1 to the ejection element P3 and the ejected amount of ink, the identification itself can be facilitated, and it is very easy to cope with automation of the measurement, wherein it is possible to classify recording heads 1 without sacrificing the production efficiency, and this method is suitable for mass production.

In the measurement step, the weight of ink is measured by using the evaluation pulse generator 30 and electronic balance 31, and the natural period Tc of ink in the pressure chamber 17 is identified on the basis of the weight of ink. However, the measurement of the natural period Tc is not limited to the above-described method.

For example, by measuring the volume of ink droplets, the natural period Tc of ink in the pressure chamber 17 may be identified on the basis of the measured volume. In summary, the natural period Tc may be identified on the basis of the amount of ejected ink.

Further, the above-described measurement step may be composed of a step for measuring an ink velocity, which measures the flying velocity of ejected ink droplets, and a second period identifying step that identifies the natural period Tc on the basis of the measured flying velocity.

That is, in the case where the above-described evaluation pulses TP1 are used, the flying velocity of ink droplets may vary in proportion to the amount of ink droplets by varying the time of provision of the first holding element P2. In detail, the flying velocity of ink droplets is made the slowest in the time of supply in which the amount of ink is reduced to the least, and the more the amount of ink is increased, the more the flying velocity is increased, Therefore, in the step of measuring the ink velocity, the ink droplet velocity is measured several times while varying the time duration Pwh1 from the termination end of the excitation element P1 to the initial end of the ejection element P3 in the evaluation signals, and in the step of identifying the second cycle, the measurement of the natural period Tc can be carried out by identifying the correlation between the time duration from the excitation element P1 to the ejection element P3 and the ink droplet velocity.

And, in this case, the time duration Pwh1 from the excitation element. P1 to the ejection element P3 in the evaluation pulse Tp1 is set to the first reference time, the second reference time, and the third reference time, and the measurement of the ink droplet velocity is carried out three times, whereby it is possible to simply perform the measurement of the natural period Tc.

Further, a velocity measurement device that measures the flying velocity of ink droplets may be any type that is capable of measuring the flying velocity For example, as the velocity measurement device, such a type may be preferably employed, which is provided with a light emitter for generating a light beam (for example, a laser beam) crossing the flying locus of ink droplets, a light detector for receiving the light beam, a timer for clocking the elapsed time required from the point of time when ink droplets are ejected to the point of time when the ink droplets cross, on a detection signal of the light detector, wherein the flying velocity of ink droplets is determined by the clocking information provided by the timer.

Further, in the above-described embodiment, measurements of the amount of ink and of ink velocity are performed three times by using the three types of evaluation pulses TP1 consisting of the first evaluation pulse, the second evaluation pulse, and the third evaluation pulse. However, the method of measurement is not limited to this method.

For example, a fourth evaluation pulse in which the time duration from the excitation element P1 to the election element P3 is shorter-than the second evaluation pulse, and a fifth evaluation pulse in which the time duration from the excitation element P1 to the ejection element P3 is longer than the third evaluation pulse are further added, and the measurement is performed five times by using the five types of evaluation pulses TP1, wherein the natural period Tc may be relatively obtained on the basis of the results of the measurement. Similarly, the measurement may be performed two times by using two types of evaluation pulses TP1, wherein the natural period Tc may be relatively obtained on the basis of the results of the measurement In the case where the measurement is performed three or more times by using three or more types of evaluation pulses TP1, it is possible to further accurately obtain whether the recording head 1 has the natural period Tc as per the designed criterion, a shorter natural period Tc than the designed criterion or a longer natural period Tc than the designed criterion.

Further, in the above-described embodiment, a description was given of the case where the recording head 1 is provided with a longitudinal vibration type piezoelectric vibrator 2 as the pressure generating element. However, the present invention may be applicable to a recording head that is provided with a piezoelectric vibrator of a flexure vibration mode, a piezoelectric vibrator of a lateral vibration mode, etc.

In addition, the pressure generating element is not limited to the piezoelectric vibrator. For example, a magnetic distortion element and heating element may be used. Hereinafter, a description is given of the case where the present invention is applied to a recording head employing the heating element.

Figure 9:
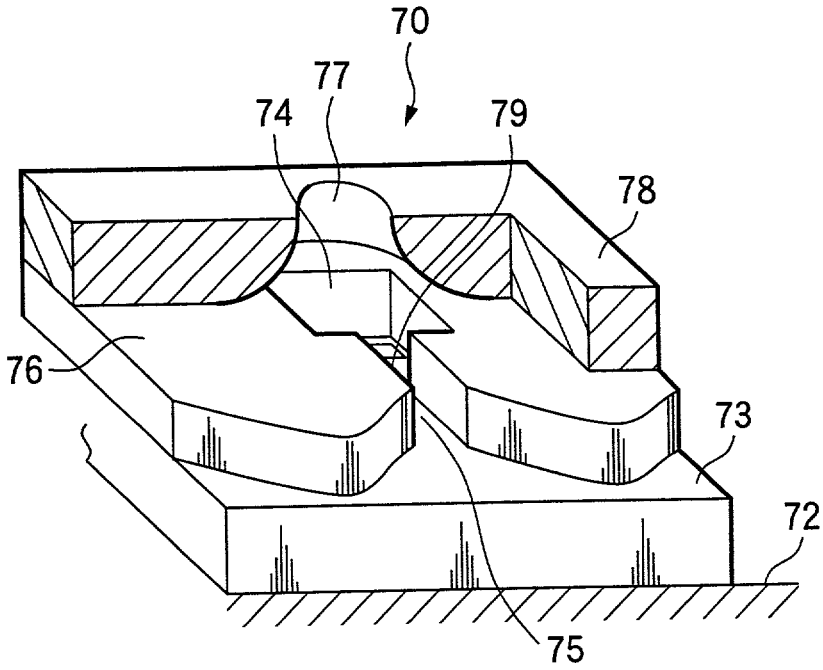
FIGS. 9 to 11 are views explaining a configuration of a recording head provided with a heating element.
Figure 10:
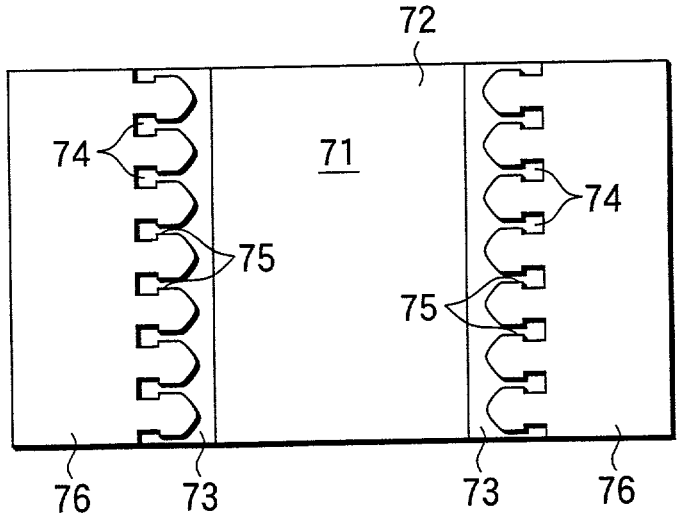
Figure 11:
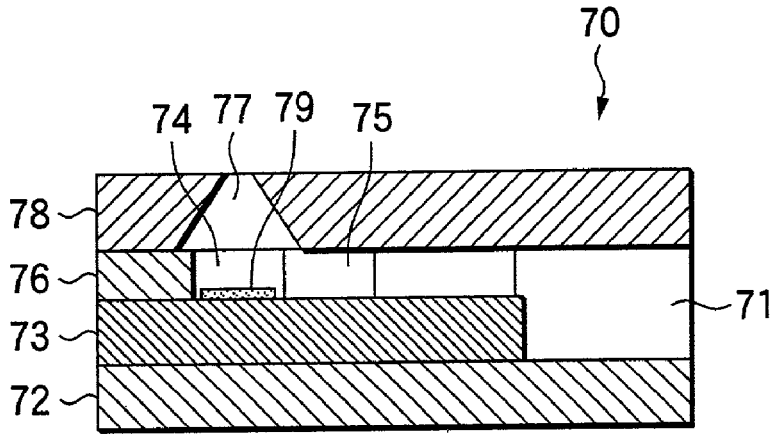

First, referring to FIGS. 9 to 11, a description is given of a configuration of a recording head 70. The recording head 70 illustrated as an example is composed of a base plate portion 72 that constitutes a part of the partition of a common ink reservoir 71, a plate-like weir forming member 73 that forms a weir to secure the depth of the common ink reservoir 71, a channel forming substrate 76 that is provided with a vacant portion that becomes a pressure chamber 74 and supply port 75, and a nozzle plate 78 in which a plurality of nozzle orifices 77 are provided like a line.

And, the recording head 70 is prepared by adhering the weir forming member 73 onto the base plate portion 72, a channel forming substrate 76 onto the face of the weir forming member 73 at the opposite side of the base plate portion 72, the nozzle plate 78 onto the face of the channel forming substrate 76 at the opposite side of the weir forming member 73.

In the recording head 70, the common ink reservoir 71 is caused to communicate with the pressure chamber 74 by a narrowed ink supply port 75. Further, the pressure chamber 74 is prepared to be a roughly rectangular vacant portion, and nozzle orifices 77 are caused to communicate with the pressure chamber 74. The nozzle orifices 77 are formed to be roughly, tapered so as to widen toward the pressure chamber 74 side, the area of the openings at the pressure chamber 74 side is formed to be so wide as to cover the opening of the pressure chamber 74.

And, in the recording head 70, ink channels that communicate from the common ink reservoir 71 to the nozzle orifices 77 through the ink supply port 75 and the pressure chamber 74 are formed by the number corresponding to the number of the nozzle orifices 77. Further, a heating element 79 serving as the pressure generating element is provided on an inner wall face of the pressure chamber 74, which corresponds to the nozzle orifices 77.

Figure 12A:
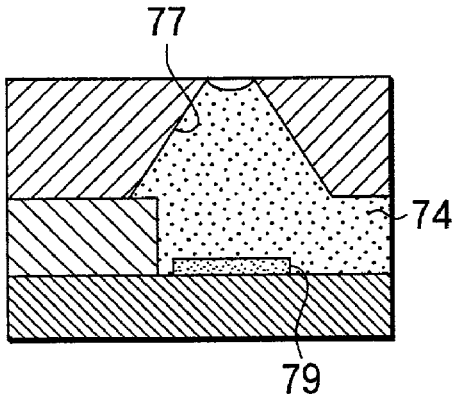
FIGS. 12A and 12B are views explaining the motions of the recording head provided with the heating element.
Figure 12B:
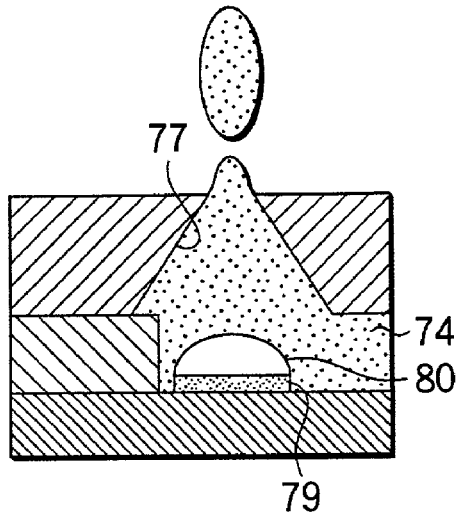

When ink droplets are ejected by the recording head 70 by radically heating the heating element 79 from its stationary state, the ink on the heating element 79 is boiled to generate air bubbles in the pressure chamber 74. That is, in the stationary state shown in FIG. 12 the heating element 79 is placed in a non-heated state. In this stationary state, since no air bubbles are generated on the heating element 79, no ink droplets are provided. And, as the heating element 79 is heated from the stationary state, as shown In FIG. 12B, the ink on the heating element 79 is boiled to cause air bubbles 80 to be generated, where the ink is radically expanded to pressurize the ink in the pressure chamber 74. As a result, ink that is pushed out through the nozzle orifices 77 is made into ink droplets and is flied as ink droplets.

Figure 13:
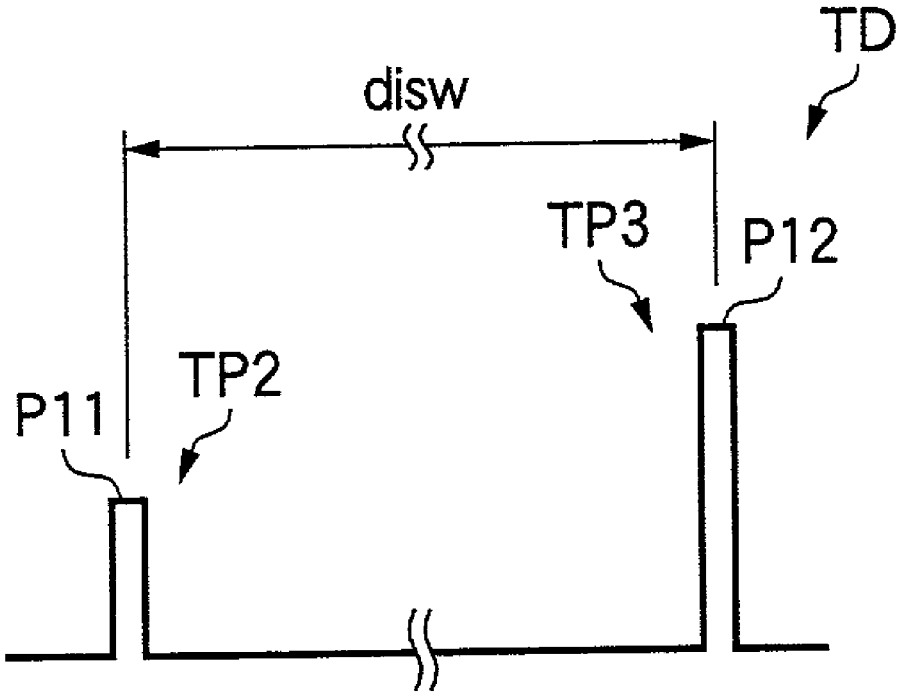
FIG. 13 is a view explaining an evaluation drive signal for the recording head provided with the heating element.

In order to measure the natural period Tc of the ink pressure in the pressure chamber 74 in the recording head 70 thus constructed, for example, an evaluation drive signal TD (an evaluation signal) shown in FIG. 13 is generated from an evaluation signal generator (not illustrated), and is supplied to the recording head 70, thereby ejecting ink droplets.

The evaluation drive signal TD includes an excitation pulse TP2 including an excitation element P11 that causes the ink in the pressure chamber 74 to excite pressure vibrations of the natural period Tc, and an ejection pulse TP3 including an ejection element P12 that is generated after the excitation pulse TP1 and ejects ink droplets from the nozzle orifices 77. And, the amount of ink can be varied, as in the above-described embodiment, by varying the time duration disw from the excitation element P11 to the ejection element P12. Therefore, measurement of the amount of ink is carried out several times by varying the time duration disw from the excitation element P11 to the ejection element P12 in the evaluation signal, wherein the natural period Tc can be measured from the correlation between the time duration disw and the amount of ink or the flying velocity And, by classifying the assembled recording head 70 into a plurality of Tc ranks on the basis of the measured natural period Tc, as described later, it is possible to set a recording drive signal COM for each of the Tc ranks, whereby uniformizing of image quality can be carried out. Further, since the process is easy and simple, it is possible to classify the recording heads 70 without sacrificing production efficiency, wherein the recording heads 70 are suitable for mass production.

Figure 14:
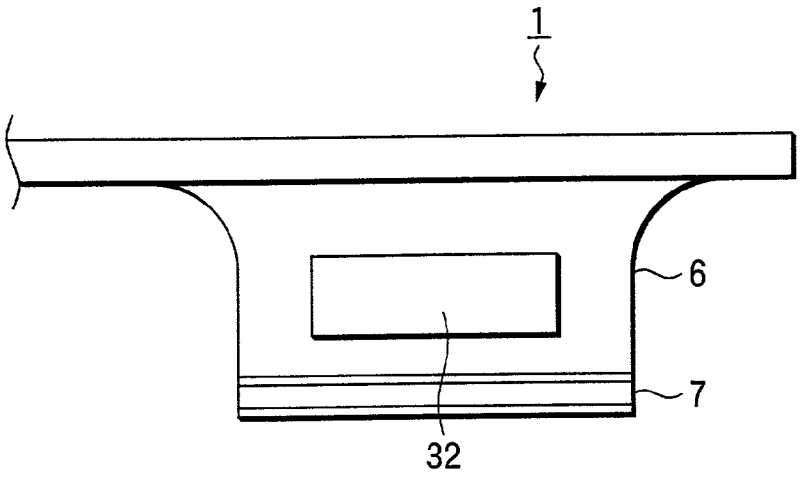
FIG. 14 is a view explaining a recording head provided with a rank indicator.

Further, recording heads 1 (70) classified Tc rank by Tc rank are marked with respective Tc ranks. The Tc rank marking is performed by, for example, a rank indicator 32 as shown in FIG. 14. A label member and a plate member having an adhesive layer formed on the rear side thereof may be preferably employed as the rank indicator 32.

Further, rank identifying information provided with the rank indicator 32 may be constituted by identifying information composed of symbols such as letters, numerical figures, images, etc., and coded information that is optically readable by a scanner.

And, symbols expressing the Tc ranks (first rank identifying information) may be employed as the above-described identifying information.

For example, in the case where the Tc rank ID of the reference rank is 0, the Tc rank ID of the minimum rank is 1, and the Tc rank ID of the maximum is 2, "0", "1" and "2" may be used as the identifying information. Similarly, letters of the alphabet may be used instead.

In addition, in the recording heads 1 provided with a plurality of the above-described nozzle rows, symbols that express combinations of Tc ranks of the nozzle rows (second rank identifying information) may be used.

For example, in the recording head 1 in which two nozzle rows are provided and respective nozzle rows are classified into three ranks (reference, minimum and maximum), the identifying information may be set as described below. That is, in the case where both the first nozzle row and the second nozzle row are in the reference rank, "A" may be used as the identifying information. Further, in the case where the first nozzle row is in the reference rank while the second nozzle row is in the minimum rank, "B" may be used as the identifying information. Still further, in the case where the first nozzle row is in the reference rank while the second nozzle row is in the maximum rank "C" may be used as the identifying information. Similarly, respective combinations of nine Tc ranks are given the identifying information.

By employing such a configuration, even in the recording head 1 provided with a plurality of nozzle rows, the number of identifying information that is expressed on the rank indicator 32 can be reduced, wherein a marking domain of the rank indicator 32 may be effectively utilized. For example, other information may be provided in the marking domain.

A pattern image in which binary image information read by a scanner can be converted to the Tc rank ID may be used as the above-described coded information. For example, a bar code that is composed of a plurality of parallel lines having various line widths may be preferably employed. Thus, if the coded information is used as the rank identifying information, it becomes possible to automatically read the Tc rank information of the corresponding recording head 1 by a scanner and a line sensor if the rank indicator 32, on which the coded information is written, is attached to a predetermined position of the recording head 1. Therefore, when setting the drive waveform suitable for the recording head 1, work of reading the Tc rank information can be automated, and is able to contribute to the improving of working efficiency.

Figure 15:
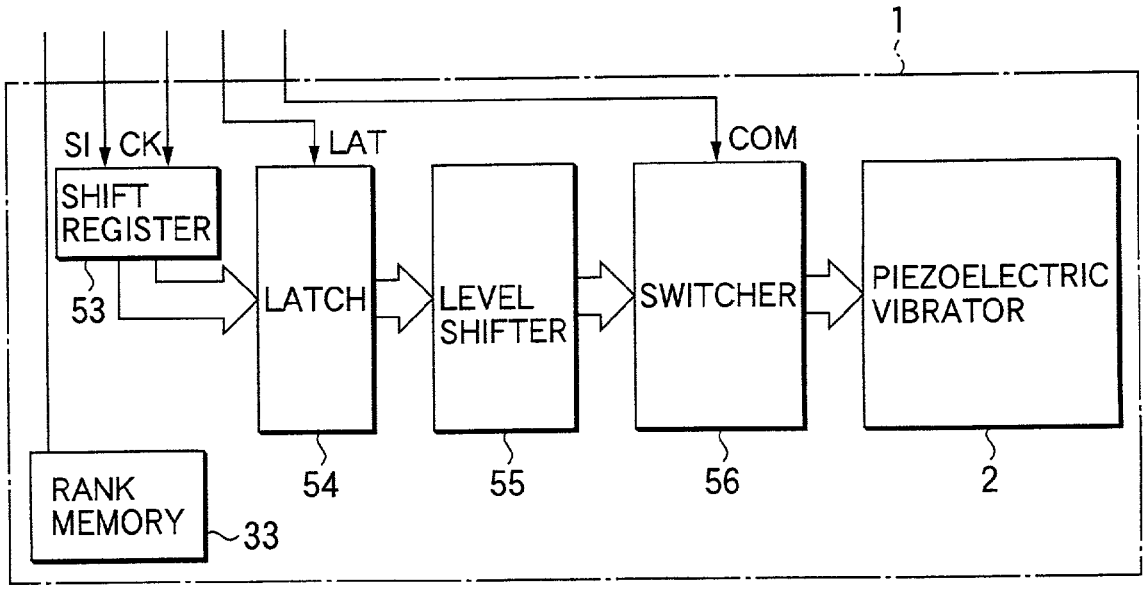
FIG. 15 is a view explaining a recording head provided with a memory element for storing rank identifying information.

Further, with respect to the above-described Tc rank, as shown in, for example, FIG. 15, the rank identifying information showing the Tc rank may be electrically stored in a rank ID memory 33. In this case, the rank ID memory 33 is incorporated in the recording head 1.

The rank ID memory 33 may be any element that is capable of electrically reading the rank identifying information. For example, a non-volatile memory, in which information may be rewritable, such as EEPROM and IC memory may be preferably used.

Figure 16:
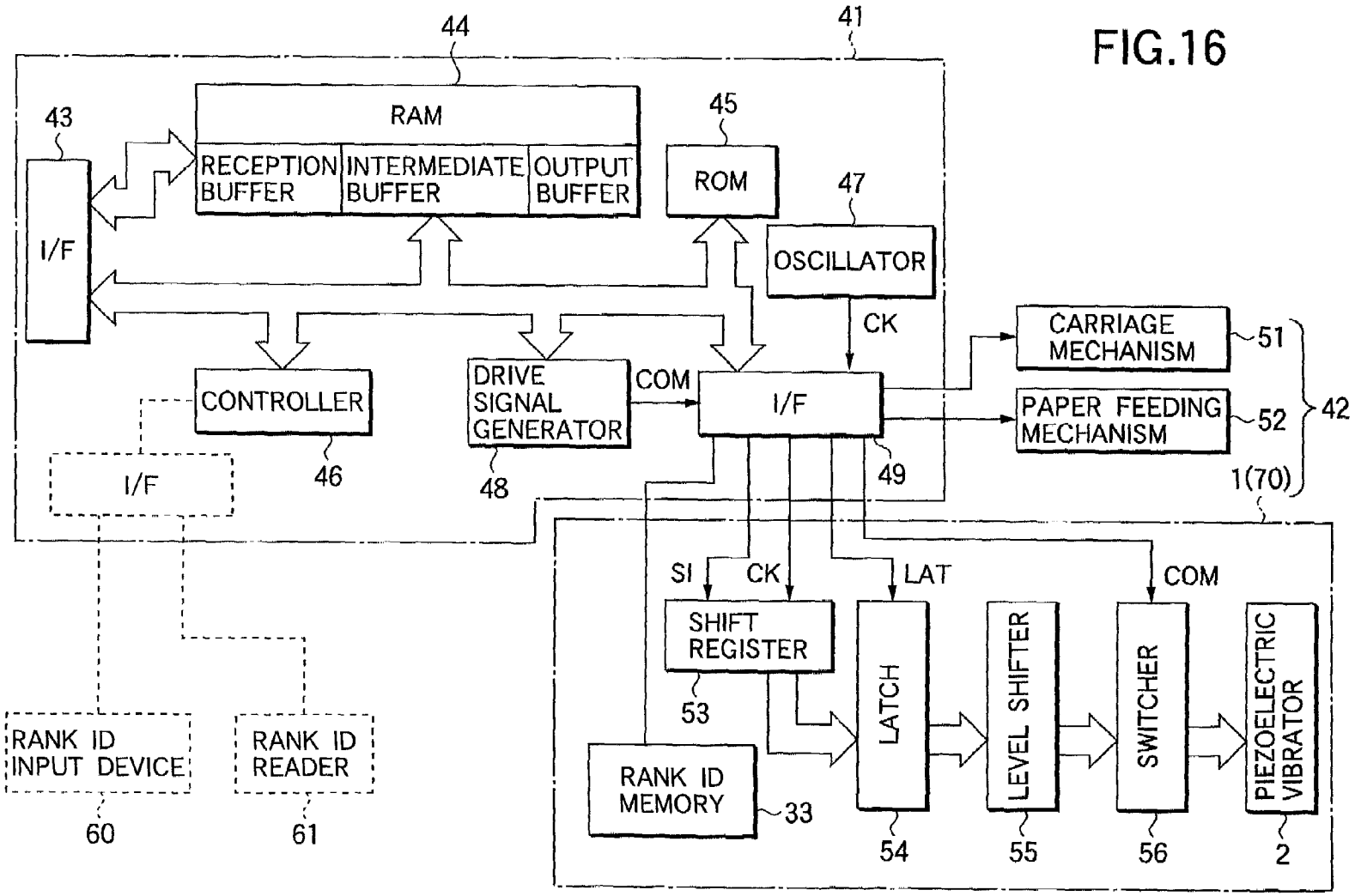
FIG. 16 is a block diagram explaining an electric configuration of the recording head.

In this configuration, as shown in FIG. 16, since the rank ID memory 33 is electrically connected to a controller 46 of the recording apparatus, it is possible to automate the reading of the rank identifying information.

Next, a description is given of a method for using the Tc ranks attached to the recording head 1, that is, a procedure for setting control factors of waveform elements that constitute a drive signal. Herein, FIG. 16 is a block diagram explaining an electrical construction of an ink jet type recording apparatus such as a printer and a plotter, etc.

The illustrated recording apparatus is provided with a printer controller 41 and a print engine 42.

The-printer controller 41 is provided with an interface 43 that receives printing data, etc., from a host computer (not illustrated), etc., a RAM 44 that stores various types of data, a ROM 45 that stores-control routines to process various types of data, a controller 46 that serves as a waveform controller and is composed to include the CPU, an oscillator 47, a drive signal generator 48 that serves as a drive signal generator to generate a drive signal to be provided to the recording head 1, and an interface 49 that transmits printing data, which are obtained by developing the printing data dot by dot, and drive signals, etc., to the print engine 42.

The print engine 42 is composed of the above-described recording head 1, a carriage mechanism 51, and a paper feeding mechanism 52. The recording head 1 is provided with a shift register 53 in which the printing data are set, a latch 54 that latches the printing data set in the shift register 53, a level shifter 55 that serves as a voltage amplifier, the piezoelectric vibrator 2, a switcher 56 that controls the supply of drive signals to the piezoelectric vibrator 2, and the above-described rank identifying information memory element 33.

The above-described controller 46 operates in compliance with operation programs stored in the ROM 45 and controls the respective portions of the recording apparatus. The drive signal generator 48 generates a drive signal COM having a waveform that is defined by the controller 46. And, the controller 46 controls the drive signal generator 48 in accordance with the Tc rank given to the recording head 1 and defines the waveform profile of the drive signal. That is, it defines control factors of the waveform element that constitutes the drive signal.

Hereinafter, a description is given of the waveform control of the drive signal based on the Tc rank. First, a case is described, where control factors of a damping element, which damps the vibration of meniscus after ink droplets are ejected, are defined.

Figure 17:
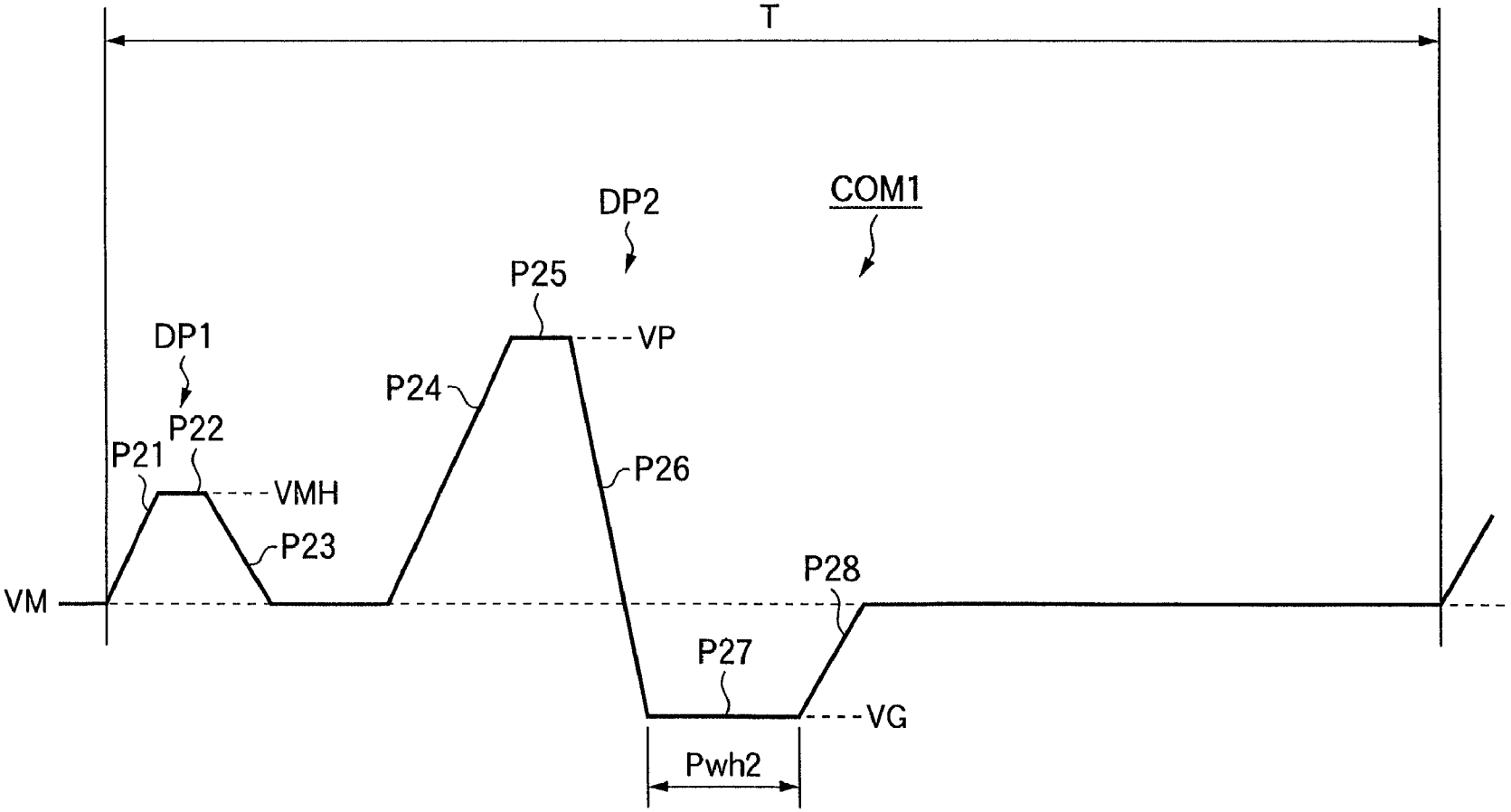
FIG. 17 is a view explaining a drive signal according to a first embodiment of the invention.

A drive signal COM1 shown in FIG. 17 includes a vibrating pulse DP1 that vibrates the meniscus, and a normal dot drive pulse DP2 that is generated after the vibrating pulse DP1 and ejects ink droplets for recording normal dots through the nozzle orifices 16. And, these vibrating pulse DP1 and normal dot drive pulse DP2 are repeatedly generated for each of the printing cycles T.

The drive signal COM1 provides any one of either the vibrating pulse DP1 or normal dot drive pulse DP2 to the piezoelectric vibrator 2. That is, in the case where ink droplets are ejected, only the normal dot drive pulse DP2 is selected and is provided to the piezoelectric vibrator 2. In the case where no ink droplets are ejected, only the vibrating pulse DP1 is selected and is provided to the piezoelectric vibrator 2.

The vibrating pulse DP1 is composed of an expansion element P21 that raises the potential at a relatively gentle potential gradient such an extent that no ink droplets are ejected, from the intermediate potential VM to a second intermediate potential VMH that is slightly higher than the intermediate potential VM; a holding element P22 that is generated continuously from the expansion element P21 and maintains the second intermediate potential VMH for a predetermined time period; and a contraction element P23 that is generated continuously from the holding element P22 and lowers the potential at a relatively gentle potential gradient from the second intermediate potential VMH to the intermediate potential VM.

As the vibrating pulse DP1 is provided to the piezoelectric vibrator 2, the piezoelectric vibrator 2 and pressure chamber 17 operate as follows; that is, the piezoelectric vibrator 2 slightly contracts in accordance with the provision of the expansion element P21, and the pressure chamber 17 slightly expands from its stationary state. The pressure inside the pressure chamber 17 is reduced in accordance with the expansion, wherein the meniscus is slightly retreated to the pressure chamber side, and the expanded state of the pressure chamber 17 is held for the entire period of the provision of the holding element P22. The meniscus freely vibrates for the entire holding period. After that, since the contraction element P23 is provided and the piezoelectric vibrator 2 is slightly extended, the pressure chamber 17 contracts to its stationary state. In accordance with the contraction, the ink in the pressure chamber 17 is slightly pressurized to cause the vibration of the meniscus to be increased, whereby an increase in the viscosity in the vicinity of the nozzle orifices 16 is prevented.

The normal dot drive pulse DP2 serving as a first drive pulse of the invention, and is composed of an expansion element P24 that, from the intermediate potential VM to the maximum potential VP, raise the potential at a fixed gradient such an extent that no ink droplets are ejected; a holding element P25 that is generated continuously from the expansion element P24 and holds the maximum potential VP for a predetermined time period; an ejection element P28 that is generated continuously from the holding element P25 and radically lowers the potential from the maximum potential VP to the minimum potential VG; a holding element P27 that is generated continuously from the ejection element P26 and holds the minimum potential VG for a predetermined time period; and a damping element P28 that is generated continuously from the holding element P27 and raises the potential from the minimum potential VG to the intermediate potential VM.

In the normal dot drive pulse DP2, the respective elements from the expansion element P24 through the damping element P28 serve as a waveform elements of the present invention. Further, the expansion element P24 serves a first expansion element of the invention, the ejection element P26 serves as a first election element of the invention, the holding element P27 serves as a holding element of the invention, and the damping element P28 serves as a first damping element of the invention, respectively.

As the normal dot drive pulse DP2 is provided to the piezoelectric vibrator 2, the piezoelectric vibrator 2 and the pressure chamber 17 operate as follows;

That is, the piezoelectric vibrator 2 greatly contracts in accordance with the provision of the expansion element P24, and the pressure chamber 17 expands from its stationary state to the maximum capacity thereof. In accordance with the expansion, the pressure inside the pressure chamber 17 is reduced to cause the meniscus to be retreated to the pressure chamber side. The expanded state of the pressure chamber 17 is held for the entire period of provision of the holding element P25, wherein the meniscus freely vibrates at the natural period Tc for the entire holding period.

Subsequently, the ejection element P26 is provided and the piezoelectric vibrator 2 is greatly extended, wherein the pressure chamber 17 radically contracts to the minimum capacity thereof. In accordance with the contraction, the ink in the pressure chamber 17 is pressurized to eject ink droplets through the nozzle orifices 16. Since the holding element P27 is provided continuously from the ejection element P26, the contracted state of the pressure chamber 17 is held. However, at this time, the meniscus is influenced by the eject of ink droplets and greatly vibrates.

After that, the damping element P28 is provided at a timing that counterbalances the vibration of the meniscus, wherein the pressure chamber 17 expands to its stationary state and is reset That is, the pressure chamber 17 is caused to expand to reduce the ink pressure in the pressure chamber 17, thereby counterbalancing the ink pressure, whereby it is possible to suppress the vibration of the meniscus in a short time, and the next eject of ink droplets can be stabilized.

And, the controller 46 controls the drive signal generator 48 in accordance with the Tc rank, and varies the time Pwh2 of generation of the holding element P28, which occurs between the ejection element P26 and the damping element P28. That is, the controller 46 varies the pressure reducing timing of the pressure chamber 17 by the damping element P28 in accordance with the Tc rank For example, with respect to the recording heads 1 of the reference rank and the maximum rank, the time Pwh2 of generation is set to 4.5 $\mu$s, and with respect to the recording heads of the minimum rank, the time Pwh2 of generation is set to 3.3 $\mu$s.

Thus, if the time of Pwh2 of generation of the holding element P27 is varied in accordance with the Tc rank, it is possible to efficiently suppress the vibration of the meniscus.

That is, after ink droplets are ejected, the vibration of the meniscus is greatly influenced by the ink pressure in the pressure chamber 17. That is, the meniscus vibrates upon being greatly influenced by the natural period Tc. Therefore, by varying the time Pwh2 of generation of the holding element P27 in accordance with the Tc rank, it is possible to provide the damping element P28 at a timing suited to the natural period Tc of the recording heads 1. Accordingly, it is possible to efficiently suppress the vibration of the meniscus.

Furthermore, in connection with the holding element P27, the same modification is provided for the recording heads 1 classified to the same Tc rank, wherein no exclusively different waveforms are used in each of the recording heads 1. Therefore, it is very efficient when performing mass production of the recording heads. Still further, since differences in respective recording heads 1 can be compensated in the process of production, recording heads that are obliged to be abolished conventionally can be incorporated in recording apparatuses, wherein the yield ratio can be increased.

Further, in the present embodiment, the same time Pwh2 of generation is employed in both the recording head 1 of the reference rank and recording head 1 of maximum rank. However, it is needless to say that separate times Pwh2 of generation may be employed in the recording heads 1 of the reference rank and recording heads 1 of maximum rank.

Next, a description is given of an example in which the time duration of a waveform element, which connects a termination end of a preceding drive pulse and an initial end of a subsequent drive pulse generated in the same printing cycle, is defined depending on the Tc ranks.

Figure 18:
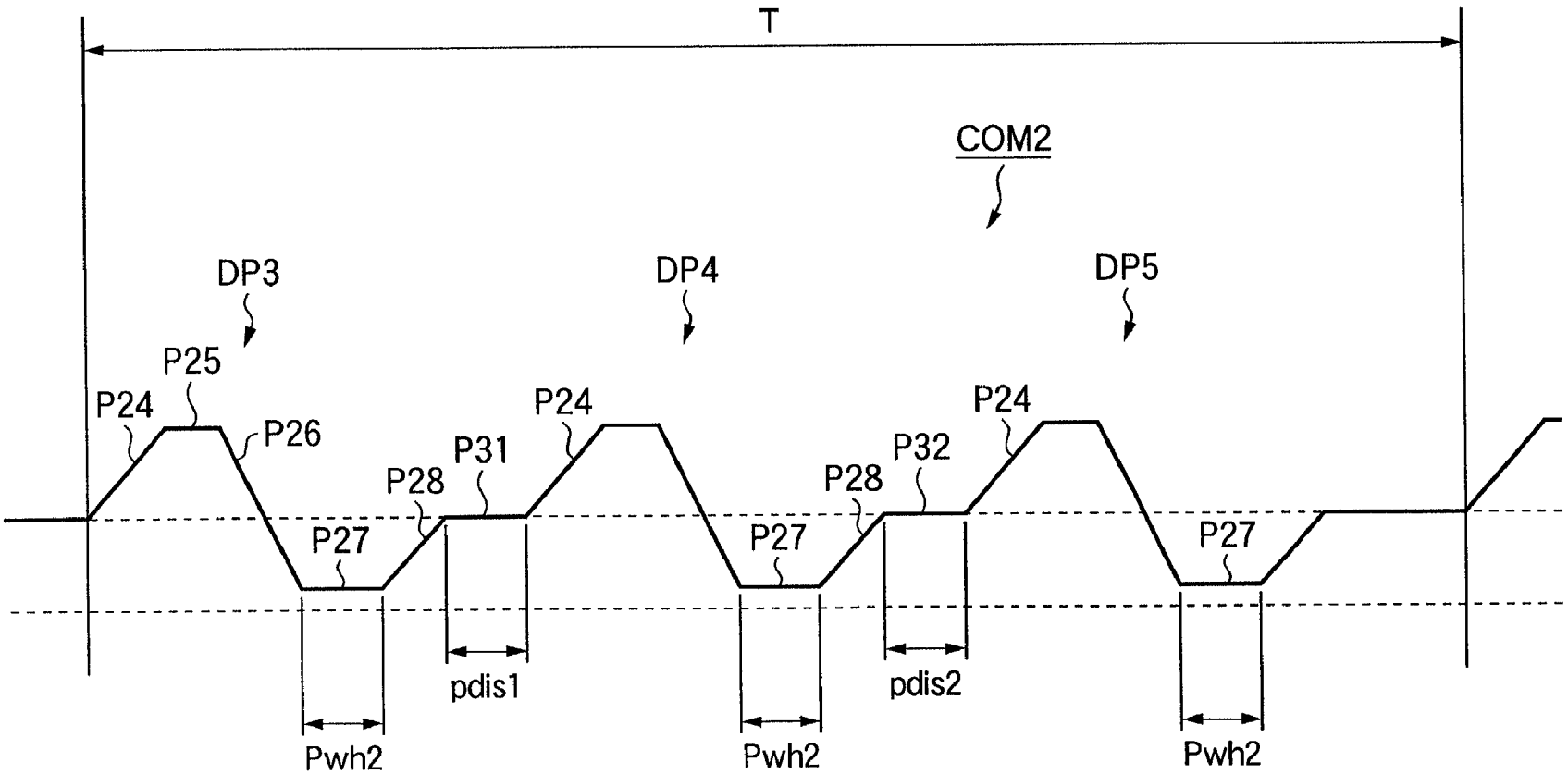
FIG. 18 is a view explaining a drive signal according to a second embodiment of the invention.

A drive signal COM2 illustrated in FIG. 18 includes three normal dot drive pulses in one printing cycle T, and these normal dot drive pulses DP3 through DP5 are repeatedly generated in each of the printing cycles T.

And, these drive pulses DP3 through DP5 are selected in response to the gradation of dots in the drive signal COM2 and are provided to the. piezoelectric vibrator 2. For example, in the case where the dot pattern data is (01), only the second normal dot drive pulse DP4 is provided to the piezoelectric vibrator 2. Further, in the case where the dot pattern data is (10), the first normal dot drive pulse DP3 and the third normal dot drive pulse DP5 are provided to the piezoelectric vibrator 2. Furthermore, where the dot pattern data is (11), the respective normal dot drive pulses DP3 through DP5 are provided to the piezoelectric vibrator 2.

The respective normal dot drive pulses DP3 through DP5 serve as the first drive pulse of the invention as in the above-described normal dot drive pulse DP2. And, respective waveform elements P24 through P28 that constitute these normal dot drive pulses DP3 through DP5 are similar to the waveform elements P24 through P28 of the normal dot drive pulse DP2. Therefore, herein, a description thereof is omitted.

With the drive signal COM2, connecting elements P31 and P32 are generated between the normal dot drive pulses, and the normal dot drive pulses are connected to each other in series.

That is, the connecting element P31 connects the termination end of the normal dot drive pulse DP3 (corresponding to a preceding drive pulse of the invention) with the initial end of the normal dot drive pulse DP4 (corresponding to a subsequent drive pulse of the invention). In addition, the connecting element P32 connects the termination end of the normal dot drive pulse DP4 (corresponding to the preceding drive pulse of the invention) to the initial end of the normal dot drive pulse DP5 (corresponding to the subsequent drive pulse of the invention).

Therefore, with the drive signal COM2, the connecting elements P31 and P32 serve as a second connecting element of the invention.

And, the controller 46 controls the drive signal generator 48 in accordance with the Tc ranks, and varies the time Pwh2 of generation of the holding element P27, the time pdis1 of generation of the connecting element P31, and the time pdis2 of generation of the connecting element P32.

This is to make uniform the ejection timings of ink droplets by respective normal dot drive pulses DP3 through DP5. That is, the provision timing of the damping element P28 can be optimized by varying the time Pwh2 of generation. However, the provision timing of the normal dot drive pulses DP4 and DP5 may change on the basis of the modification (variation) of only the time Pwh2 of generation. Accordingly, by adequately varying the time pdis1 of generation and time pdis2 of generation in addition to the modification of the time Pwh2 of generation, the ejection timing of ink droplets is made uniform, whereby since the ejection timings of ink droplets can be made uniform in the respective normal dot drive pulses DP3 through DP5, the landing positions of ink droplets can be made uniform, and the image quality can be improved.

Figure 19:
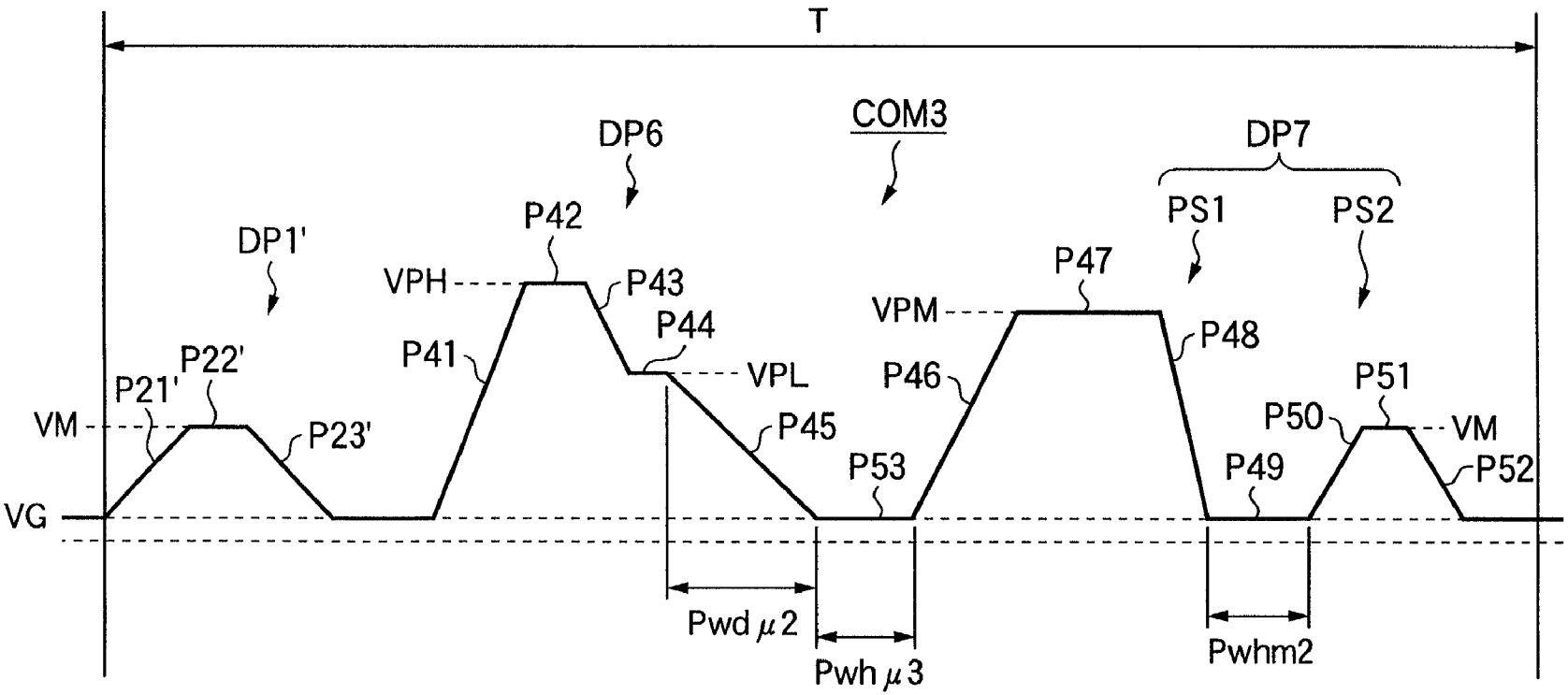
FIG. 19 is a view explaining a drive signal according to a third embodiment of the invention.

A drive signal COM3 illustrated in FIG. 19 includes a vibrating pulse DP1' that vibrates the meniscus; a microdot drive pulse DP6 that is generated after the vibrating pulse DP1' and ejects ink droplets for recording microdots through nozzle orifices 16; a middle dot drive pulse DP7 that ejects ink droplets for recording middle dots through the nozzle orifices 16. These drive pulses DP'1, DP6 and DP7 are repeatedly generated in each of the printing cycles T.

With the drive signal COM3, in the case where no ink droplets are ejected, only the vibrating pulse DP1' is selected and is provided to the piezoelectric vibrator 2. In the case where the dot pattern data are data for microdot recording, only the microdot drive pulse DP6 is provided to the piezoelectric vibrator 2. Further, in the case where the dot pattern data are data for the middle dot recording, only the middle dot drive pulse DP7 is provided. Further, in the case where the dot pattern data are-data for large dot recoding, both the microdot drive pulse DP6 and middle dot drive pulse DP7 are provided to the piezoelectric vibrator 2.

The vibrating pulse DP1' is a drive pulse, which vibrates the meniscus of ink in the nozzle orifice 16, like the above-described vibrating pulse DP1, and includes an expansion element P21', a holding element P22', and a contraction element P23'.

A difference between the vibrating pulse DP1' and the vibrating pulse DP1 is placed in that the vibrating pulse DP1' varies the potential in the range from the minimum potential VG to the intermediate potential VM while the vibrating pulse DP1 varies the potential in the range from the intermediate potential VM to the second intermediate potential VMH. All other points remain unchanged. Therefore, a detailed description thereof is omitted herein.

The microdot drive pulse DP6 serves as a second drive pulse of the invention, and is composed of an expansion element P41 that raises the potential from the minimum potential VG to a maximum potential VPH at a relatively steep gradient; a holding element P42 that is generated continuously from the expansion element P41 and holds the maximum potential VPH for a remarkably short time period; an ejection element P43 that lowers the potential from the maximum potential VPH to a second maximum potential VPL, which is slightly lower than the-maximum potential VPH, at a relatively steep gradient; an eject holding element P44 that holds the second maximum potential VPL for a remarkably short time period; and a damping element P45 that lowers the potential from the second maximum potential VPL to the minimum potential VG at a relatively gentle gradient.

In the microdot drive pulse DP6, respective elements from the expansion element P41 to the damping element P45 serve as the waveform elements of the invention. Further, the expansion element P41 serves as a second expansion element of the invention, the ejection element P43 serves as a second ejection element of the invention, and the damping element P45 serves as a second damping element of the invention.

As the microdot drive pulse DPG is provided to the piezoelectric vibrator 2, the piezoelectric vibrator 2 and the pressure chamber 17 operate as follows;

That is, the piezoelectric vibrator 2 greatly contracts in accordance with the provision of the expansion element P41, and the pressure chamber 17 radically expands from the minimum capacity to the maximum capacity. In accordance with the expansion, the pressure in the pressure chamber 17 is greatly reduced, wherein the meniscus is greatly retreated to the pressure chamber side. At this time, the center portion of the meniscus or the vicinity of the center of the nozzle orifices 16 is greatly retreated once, and is thereafter swelled and made convex by its reaction. Next, the holding element P42 and the ejection element P43 are continuously provided. The pressure chamber 17 slightly contracts in accordance With the provision of the ejection element P43, and the ink is slightly pressurized, wherein the ink existing at the center portion of the meniscus is ejected as ink droplets. The meniscus greatly vibrates in accordance with the eject of the ink droplets. The pressure chamber 17 slowly contracts by the damping element P45 that is provided thereafter, and after the ink droplets are ejected, the meniscus vibration is suppressed.

And, the controller 46 controls the drive signal generator 48 in accordance with the Tc ranks, and varies the time Pwdμ2 of generation of the damping element P45. That is, the contraction rate of the pressure chamber 17, which is defined by the damping element P45 in accordance with the Tc ranks, is varied Concurrently, the time Pwhμ3 of generation of the connecting element P53 that is generated between the microdot drive pulse DP6 and the middle dot drive pulse DP7 is also varied.

For example, with respect to the recording heads 1 having a reference rank, the time Pwdμ2 of generation is set to 4.3 μs, and the time Pwhμ3 of generation is set to 11.0 μs, respectively, and with respect to the recording heads 1 having the minimum rank, the time Pwdμ2 of generation is set to 4.1 μs, and the time Pwhμ3 of generation is set to 11.2 μs, respectively. Further, with respect to the recording heads 1 having the maximum rank, the time Pwdμ2 of generation is set to 4.7 μs, and the time Pwhμ3 of generation is set to 10.6 μs, respectively.

This is also to efficiently suppress the vibration of the meniscus. That is, immediately after ink droplets are ejected, the meniscus greatly vibrates upon being influenced by the natural period Tc. Therefore, the pressurizing rate of ink in the pressure chamber 17 is varied by varying the time Pwdμ2 of generation of the damping element P45 in accordance with the Tc rank whereby it is possible to efficiently suppress the pressure vibrations in the ink.

Furthermore, since the time Pwhμ3 of generation of the connecting element P33 is concurrently varied, it is possible to make uniform the ejection timings of ink droplets by the middle dot drive pulse DP7 that is generated next.

Next, a description is given of the middle dot drive pulse DP7. The middle dot drive pulse DP7 serves as a third drive pulse of the invention, and is provided with an ejection pulse PS1 that ejects ink droplets; a damping pulse PS2 that is generated after the ejection pulse PS1 and suppresses the vibration of the meniscus after ink droplets are ejected; and the first connecting element P49 that connects between the ejection pulse PS1 and the damping pulse P52.

The ejection pulse PS1 is composed of an expansion element P46 that raises the potential from the minimum potential VG to a third maximum potential VPM such an extent that no ink droplets are ejected; a holding element P47 that is generated continuously from the expansion element P46 and holds the third maximum potential VPM for a predetermined time period; and an ejection element P48 that lowers the potential from the third maximum potential VPM to the minimum potential VG at a relatively steep gradient.

Further, the third maximum potential VPM is set to a potential, which is lower than the maximum potential VPH but is higher than the second maximum potential VPL.

The damping pulse PS2 is composed of an expansion element P50 that raises the potential from the minimum potential VG to the intermediate potential VM at a relatively gentle gradient such an extent that no ink droplets. are ejected, a holding element P51 that is generated continuously from the expansion element P50 and holds the intermediate potential VM for a predetermined time period; and a contraction element P52 that is generated continuously from the holding element PS1 and lowers the potential from the intermediate potential VM to the minimum potential VG at a relatively gentle gradient.

And, a first connecting element P49 connects the termination end of the ejection element P48 in the ejection pulse PS1 to the initial end of the expansion element P50 in the damping pulse PS2.

In the middle dot drive pulse DP7, the respective elements from the expansion element P46 to the contraction element P52 serve as the waveform elements of the invention. And, the ejection pulse PS1 serves as an ejection pulse of the invention, and the damping pulse P82 serves as an damping pulse of the invention. Further, the first connecting element 49 serves as a first connecting element of the invention.

As the middle dot drive pulse DP7 is provided to the piezoelectric vibrator 2, the piezoelectric vibrator 2 and the pressure chamber 17 operates as follows.

That is, the piezoelectric vibrator 2 greatly contracts in accordance with the provision of the expansion element P46, wherein the pressure chamber 17 greatly expands from the minimum capacity. The expanded state of the pressure chamber 17 is held for the period of provision of the holding element P47. And, for the period of holding, the retreated meniscus is returned to the vicinity of the open edge of the nozzle orifices 16 by the fluctuation in pressure of ink. After that, the ejection element P48 is provided, and ink droplets corresponding to the middle dot are ejected from the nozzle orifices 16.

The first connecting element P49 is provided continuously from the ejection element P48. Since the potential of the first connecting element P49 is the minimum potential VG, the contracted state of the pressure chamber 17 is held. And, for the period of holding, the meniscus greatly vibrates upon being influenced by the eject of ink droplets.

After that, the expansion element P50 is provided at the timing that counterbalances the vibration of the meniscus, wherein the pressure chamber 17 expands again, thereby reducing the pressure of the ink in the pressure chamber 17. Furthermore, after the time defined by the holding element P51 elapses, the contraction element P52 is provided, wherein the pressure chamber 17 is caused to contract so as to counterbalance the vibration of the meniscus. Then, the ink is pressurized.

And, the controller 46 controls the drive signal generator 48 in accordance with the Tc ranks, and varies the time of Pwhm2 of generation of the first connecting element P49. That is, the timing of provision of the damping pulse PS2 is varied in accordance with the Tc ranks.

In other words, the time duration of the second damping element of the second drive pulse and the time duration of the first connecting element of the third drive pulse are varied in accordance with the Tc ranks.

For example, with respect to the recording heads 1 having a reference rank, the time Pwhm2 of generation is set to 4.0 μs, with respect to the recording heads 1 of the minimum rank, the time Pwhm2 is set to 2.8 μs, and with respect to the recording heads 1 of the maximum rank, the time Pwhm2 of generation is set to 5.4 μs.

Thereby, an action that is similar to that when the time Pwh2 of generation of the above-described holding element P27 is varied can be brought about, wherein it is possible to efficiently suppress the vibration of the meniscus.

In the respective above-described drive signals COM1 through COM3, a description was given of the example in which the control factors of the damping element were controlled in accordance with the Tc ranks. However, the present invention is not limited to the example. For example, control factors of characteristic changing elements, which exert influence on the ejection characteristics of ink droplets, may be defined in accordance with the Tc ranks. Hereinafter, a description is given of examples in which the control factors of the characteristic changing elements are controlled.

Figure 20:
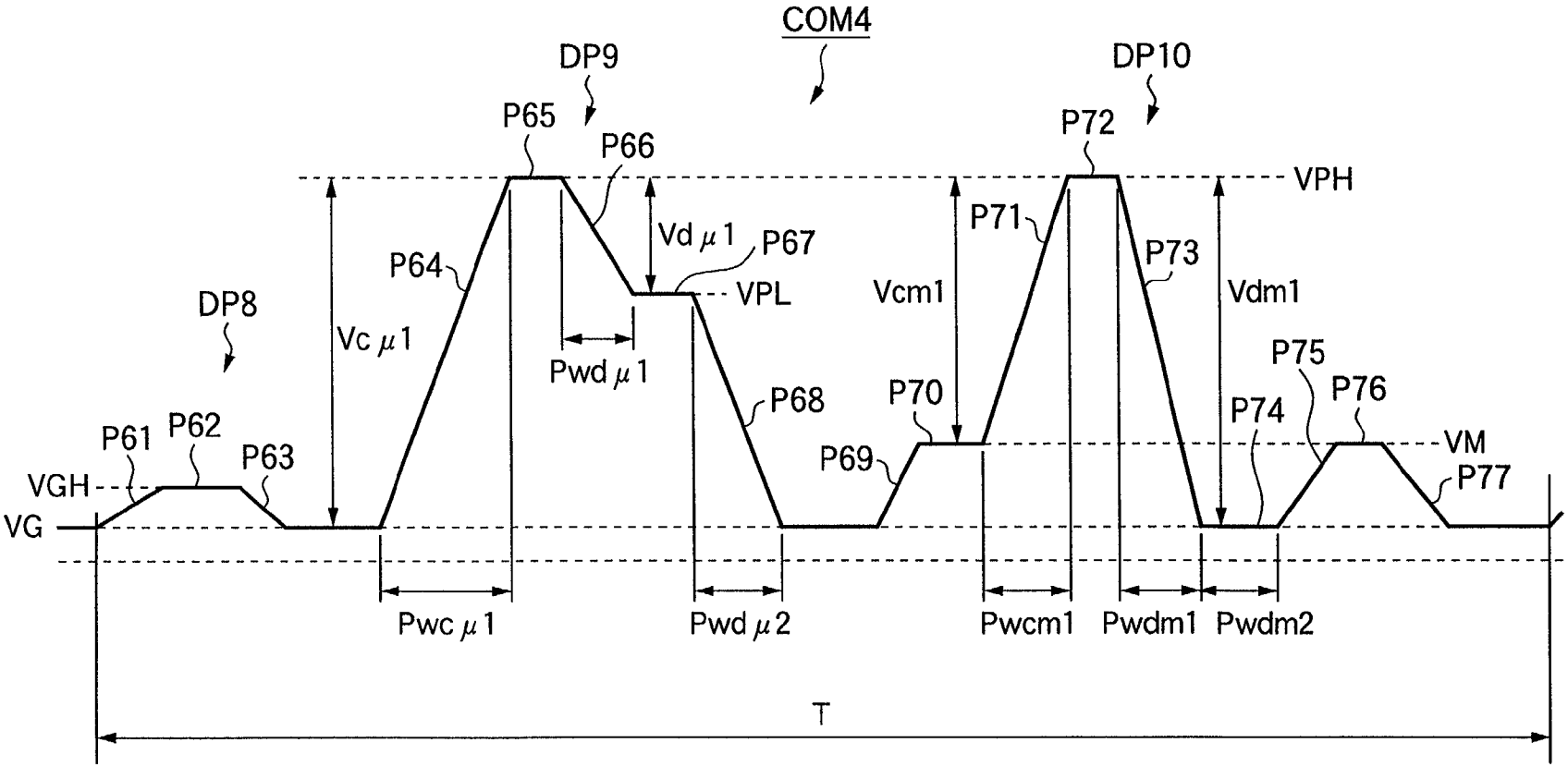
FIG. 20 is a view explaining a drive signal according to a fourth embodiment of the invention.

A drive signal COM4 illustrated in FIG. 20 includes a vibrating pulse DP8 that vibrates the meniscus; a microdot drive pulse DP9 that is generated after the vibrating pulse DP8 and ejects ink droplets for recording microdots through the nozzle orifices 16; a middle dot drive-pulse DP10 that ejects ink droplets for recording middle dots through the nozzle orifices 16, and these drive pulses DP8, DP9 and DP10 are repeatedly generated in each of the printing cycles T.

With the drive signal COM4, only the vibrating pulse DP8 is selected in the case where no ink droplets are ejected, and is provided to the piezoelectric vibrator 2. In the case where the dot pattern data is for microdot recording, only the microdot drive pulse DP9 is provided to the piezoelectric vibrator 2. Further, in the case where the dot pattern data is for middle dot recording, only the middle dot drive pulse DP10 is provided to the piezoelectric vibrator 2. Further, in the case where the dot pattern data is for large dot recording, both the microdot drive pulse DP9 and middle dot drive pulse DP10 are provided to the piezoelectric vibrator 2.

The vibrating pulse DP8 is a drive pulse that vibrates the meniscus of ink in the nozzle orifices 16, similar to the above-described vibrating pulses DP1 and DP1'. And, the vibrating pulse DP8 is composed of an expansion element P61 that raises the potential from the minimum potential VG to a second minimum potential VGH, which Is slightly higher than the minimum potential VG, at a relatively gentle gradient such an extent that no ink droplets are ejected; a holding element P62 that is generated continuously from the expansion element P61 and holds the second minimum potential VGH for a predetermined time period; and a contraction element P63 that is generated continuously from the holding element P62 and lowers the potential from the second minimum potential VGH to the minimum potential VG at a relatively gentle gradient.

And, as the vibrating pulse DP8 is provided to the piezoelectric vibrator 2, the piezoelectric vibrator 2 and pressure chamber 17 operate as in the case where the vibrating pulse DP1 and DP1' are provided, and prevents the viscosity of ink in the vicinity of the nozzle orifices 16 from increasing.

The microdot drive pulse DP9 has almost the same waveform as that of the above-described microdot drive pulse DP6, and serves as a sixth drive pulse and a seventh drive pulse of the invention.

The microdot drive pulse DP9 is composed of an expansion element P64 that raises the potential from the minimum potential VG to the maximum potential VPH at a relatively gentle gradient, a holding element P65 that is generated continuously from the expansion element P64 and holds the maximum potential VPH for a remarkably short time period; an ejection element P66 that lowers the potential from the maximum potential VPH to the second maximum potential VPL, which is slightly lower than the maximum potential VPH at a relatively steep gradient; a holding element P67 that holds the second maximum potential VPL for a remarkably short time period; and a damping element P68 that lowers the potential from the second maximum potential VPL to the minimum potential VG.

In the microdot drive pulse DP9, the respective elements from the expansion element P64 to the damping element P68 serve as the waveform elements of the invention.

Further, the expansion element P64 serves as the second expansion element of the inventions and the holding element P65 serves as a second holding element of the invention. Further, the ejection element P66 serves as the second ejection element of the invention.

In addition, these expansion element P64, holding element P65 and ejection element P66 are waveform elements related to pressure fluctuation in the pressure chamber 17 for the purpose of ejecting ink droplets and serve as characteristic changing elements of the invention. That is, the expansion element P64 and the ejection element P66 are waveform elements that increases and reduce the pressure in the pressure chamber 17 in order to eject ink droplets, and the holding element P65 is a waveform element that defines the provision starting timing of the ejection element P66.

As the microdot drive pulse DP9 is provided to the piezoelectric vibrator 2, the piezoelectric vibrator 2 and the pressure chamber 17 operate as follows;

That is, the piezoelectric vibrator 2 greatly vibrates in accordance with the provision of the expansion element P64, and the pressure chamber 17 radically expands from the minimum capacity to the maximum capacity. In accordance with the expansion, the pressure In the pressure chamber 17 is greatly reduced, and the meniscus is greatly retreated to the pressure chamber 17 side. At this time, the center portion of the meniscus is largely retreated, and the center portion thereof is swelled and made convex by its reaction. After that, the holding element P65 and ejection element P66 are continuously provided, wherein, in accordance with the provision of the ejection element P65, the pressure chamber 17 slightly contracts to slightly pressurize the ink, and the ink existing at the center portion of the meniscus is ejected as ink droplets. The meniscus largely vibrates in accordance with the eject of the ink droplets. Subsequently, the holding element P67 and the damping element P68 are provided, wherein the pressure chamber 17 is caused to contract in accordance with the provision of the damping element P68, and the vibration of the meniscus is suppressed after the ink droplets are ejected.

And, the controller 46 controls the drive signal generator 48 in accordance with the Tc ranks, and it varies the time duration of the expansion element P64 and the potential difference (that is, a difference between the potential at the initial end and that at the termination end). That is, the controller 46 varies expansion rate and expansion degree (maximum expansion capacity) of the pressure chamber 17 by the expansion element P64 in accordance with the Tc ranks.

Figure 21:
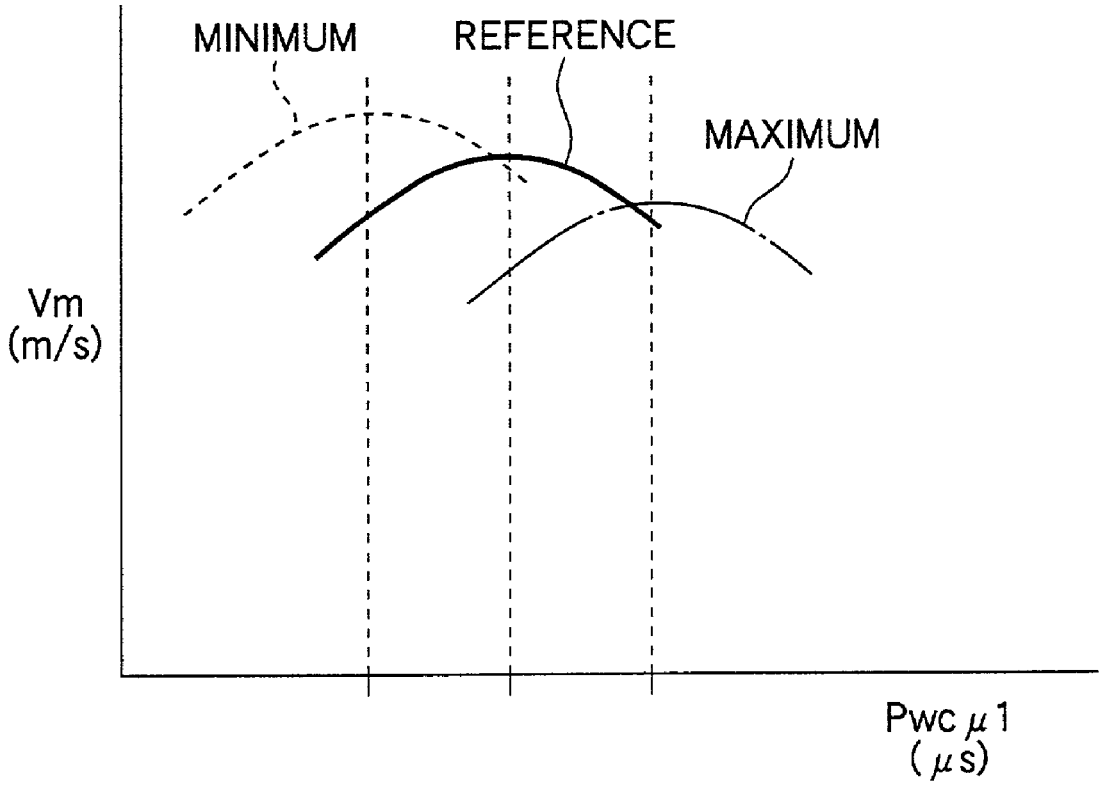
FIG. 21 is a view explaining the velocity characteristics of ink droplets in connection with the microdot drive pulse of the drive signal of FIG. 20.

For example, with respect to the recording heads 1 of maximum rank, the time Pwc$\mu$1 of generation of the expansion element PM64 is set to be longer than the time Pwc$\mu$1 at the reference rank, and the potential difference Vc$\mu$1 of the expansion element P64 is set to be larger than the potential difference Vc$\mu$1 in the reference rank. On the other hand, with respect to the recording heads 1 of minimum rank, the time Pwc$\mu$1 of generation of the expansion element P64 is set to be shorter than the time Pwc$\mu$1 at the reference rank, and the potential difference Vc$\mu$1 of the expansion element P64 is set to be smaller than the potential difference Vc$\mu$1 in the reference rank This is to optimize the velocity of ink droplets. With respect to the microdot drive pulse DP9, as shown in FIG. 21, wherein it is assumed that Pwc$\mu$1 is taken as an abscissa while the ink velocity Vm is taken as an ordinate, a characteristic curve, which is upwardly convex, can be depicted. And, the peak of the ink droplet velocity on the characteristic curve can be obtained when making the time Pwc$\mu$1 of generation coincident with the natural period Tc. This is because, by matching the time Pwc$\mu$1 of generation to the natural period Tc, an external force applied to ink by operations of the piezoelectric vibrator 2 is most efficiently converted to pressure operations of the ink. Further, in connection with the peak velocity, where the potential difference Vc$\mu$1 is matched, the velocity is delayed if the natural period Tc is long, and the velocity is increased in accordance with the natural period Tc becoming short and the response becoming fast. That is, the shorter the natural period Tc becomes, the further the ink flying velocity can be increased.

Therefore, with respect to the recording heads 1 of maximum rank, by setting the time Pwc$\mu$1 of generation of the expansion element P64 longer than the time Pwc$\mu$1 of generation in the reference rank, it is possible to most efficiently convert the external force from the piezoelectric vibrator 2 to the pressure vibrations of the ink. And, it is possible to increase the ink droplet velocity by setting the potential difference Vc$\mu$1 higher than the potential difference Vc$\mu$1 for the reference rank, wherein the ink droplet velocity can be made uniform to that in the recording head 1 having a reference rank.

To the contrary, with respect to the recording head 1 of minimum rank, by setting the time Pwc$\mu$1 of generation of the expansion element P64 shorter than the time Pwc$\mu$1 of generation in the reference rank, the external force from the piezoelectric vibrator 2 can be most efficiently converted to the pressure vibrations of the ink. And, since, in the recording head 1 of minimum rank, the ink droplet velocity is faster than that of the recording head 1 having a reference rank, it is possible to match the ink droplet velocity to that of the recording head 1 having a reference rank even if the potential difference Vcμ1 is set to be lower than the potential difference Vcμ1 for the reference rank Further, since the potential difference Vcμ1 is a factor that defines the drive voltage Vh of the drive signal COM4, it is possible to lower the drive voltage Vh since the potential difference Vcμ1 can be lowered.

If at least one of the times Pwcμ1 of generation and/or the potential difference Vcμ1 is varied, it is possible to attempt to optimize the eject characteristics of the ink droplets.

The time Pwdμ1 of generation of the ejection element P66 and the potential difference Vdμ1 may be varied by the controller 46 in accordance with the Tc rank. That is, the contraction rate of the pressure chamber 17 and contraction degree thereof may be varied by the ejection element P66. In this case, since it is possible to vary the pressurizing conditions of the pressure chamber 17 when ink droplets are ejected, it is possible to optimize the ink droplet velocity.

Further, the time duration of the holding element P65 may be varied in accordance with the Tc rank by the controller 46. That is, the holding element P65 is a waveform element that defines the provision starting timing of the ejection element P66 by holding the expanded state of the pressure chamber 17 by the expansion element P64. Therefore, by varying the time duration of the holding element P65, it is possible to optimize the timing at which the pressure chamber 17 is caused to contract. Resultantly, the pressure fluctuations in the pressure chamber 17 can be efficiently utilized, wherein it is possible to efficiently eject ink droplets.

Further, the damping element P68 brings about the same action as that of the damping element P45 in the above-described microdot drive pulse DP6. Accordingly, it is possible to efficiently control the vibration of the meniscus after ink droplets are ejected, by varying the time Pwdμ2 of generation of the damping element P68 in accordance with the Tc ranks.

The above-described middle dot drive pulse DP10 serves as a fourth drive pulse and a fifth drive pulse of the invention.

The middle dot drive pulse DP10 is composed of an auxiliary expansion element P69 that raises the potential from the minimum potential VG to the intermediate potential VM at a fixed gradient such an extent that no ink droplets are ejected; an auxiliary holding element P70 that holds the intermediate potential VM for a predetermined time period; an expansion element P71 that raises the potential from the intermediate potential VM to the maximum potential VPH at a fixed gradient such an extent that no ink droplets are ejected; a holding element P72 that holds the maximum potential VPH for a predetermined time period; an ejection element P73 that radically lowers the potential from the maximum potential VPH to the minimum potential VG; a holding element P74 that holds the minimum potential VG for a predetermined time period; a damping element P75 that raises the potential from the minimum potential VG to the intermediate potential VM; a holding element P76 that holds the intermediate potential VM for a predetermined time period; and a reset element P77 that lowers the potential from the intermediate potential VM to the minimum potential VG.

In the middle dot drive pulse DP10, the respective elements from the auxiliary expansion element P69 to the reset element P77 serve as the waveform elements of the invention. And, the expansion element P71 serves as the first expansion element of the invention, the holding element P72 serves as a first holding element of the invention, and the ejection element P73 serves as the first ejection element of the invention. That is, these expansion element P71, holding element P72, and ejection element P73 are waveform elements related to pressure fluctuations in the pressure chamber 17 for the purpose of ejecting ink droplets and also serve as the characteristic changing elements of the invention.

As the middle dot drive pulse DP10 is provided to the piezoelectric vibrator 2, the piezoelectric vibrator 2 and pressure chamber 17 operate as follows; that is, the piezoelectric vibrator 2 slightly contracts in accordance with the provision of the auxiliary expansion element P69, and the pressure chamber 17 expands from the minimum capacity to the reference capacity that is defined by the intermediate potential VM. And, by providing the auxiliary holding element P70, the reference capacity is held for a predetermined time period. Subsequently, the piezoelectric vibrator 2 largely contracts in accordance with the provision of the expansion element P71, and the pressure chamber 17 expands from the reference capacity to the maximum capacity. In accordance with the expansion, the pressure in the pressure chamber 17 is reduced. The expanded state of the pressure chamber 17 is held for the entire time period during which the holding element P72 is provided. After that, the ejection element P73 is provided to cause the piezoelectric vibrator 2 to largely extend, wherein the pressure chamber 17 radically contracts to the minimum capacity. In accordance with the contraction, the ink in the pressure chamber 17 is pressurized to cause the ink droplets to be elected through the nozzle orifices 16. And, since the holding element P74 is provided, the contracted state of the pressure chamber 17 is held, wherein the damping element P75 is provided at the timing at which the vibration of the meniscus is counterbalanced, and the pressure chamber 17 expands to the reference capacity and is reset. Thereby, it is possible to suppress the vibration of the meniscus in a short time, and it is possible to stabilize the eject of the subsequent ink droplets. In addition, the reset element P77 is provided at the timing defined by the holding element P76.

And, the controller 46 controls the drive signal generator 48 in accordance with the Tc rank and varies the time duration of the expansion element P71 and the ejection element P73, and the potential difference thereof. That is, the expansion rate and expansion degree of the pressure chamber 17, which are brought about by the expansion element P71, and contraction rate and contraction degree of the pressure chamber 17, which are brought about by the ejection element P73, are varied in accordance with the Tc ranks.

For example, in connection with the expansion element P71, the time Pwcm1 of generation with respect to the recording head 1 of maximum is set to be longer than the time Pwcm1 of generation in the reference rank, and the potential difference Vcm1 is set to be larger than the potential difference Vcm1 in the reference rant On the other hand, the time Pwcm1 of generation with respect to the recording head 1 of minimum is set to be shorter than the time Pwcm1 of generation in the reference rank and the potential difference Vcm1 is set to be smaller than the potential difference Vcm1 in the reference rank.

In connection with the ejection element P73, the time Pwdm1 of generation with respect to the recording head 1 of maximum is set to be longer than the time Pwdm1 of generation in the reference rank, and the potential difference Vdm1 is set to be larger than the potential difference Vdm1 in the reference rank. On the other hand, the time Pwdm1 of generation with respect to the recording head 1 of minimum is set to be shorter than the time Pwdm1 of generation in the reference rank, and the potential difference Vdm1 is set to be smaller than the potential difference Vdm1 in the reference rank.

Therefore, even if the natural period Tc is not even, the ejecting velocity of ink droplets can be made uniform. Further, in this case, by varying one of the times Pwcm1 and Pwdm1 of generation and one of the potential differences Vcm1 and Vdm1, it is possible to optimize the eject characteristics of ink droplets. As a matter of course, both of them may be varied.

In addition, the time duration of the holding element P72 may be varied by the controller 46 in accordance with the Tc rank. That is, the holding element P72 brings about almost the same action as that of the above-described holding element P65, wherein the provision starting timing of the ejection element P73 can be defined by holding the expanded state of the pressure chamber 17 by the expansion element P71. Accordingly, by varying the time duration of the holding element P72, it is possible to optimize the timing at which the pressure chamber 17 is caused to contract. As a result, it is possible to efficiently utilize the pressure fluctuation in the pressure chamber 17, and ink droplets can be efficiently ejected.

Further, in the middle dot drive pulse DP10, the holding element P74 defines the provision starting timing of the damping element P75. That is, the first holding element P74 can bring about an action similar to that of the first connecting element P49 in the above-described middle dot drive pulse DP7. For this reason, if the time Pwhm2 of generation of the holding element P74 is varied in accordance with the Tc rank, it is possible to efficiently control the vibration of the meniscus after ink droplets are ejected.

Next, a description is given of another example in which the control factors of the characteristic changing elements are controlled.

Figure 22:
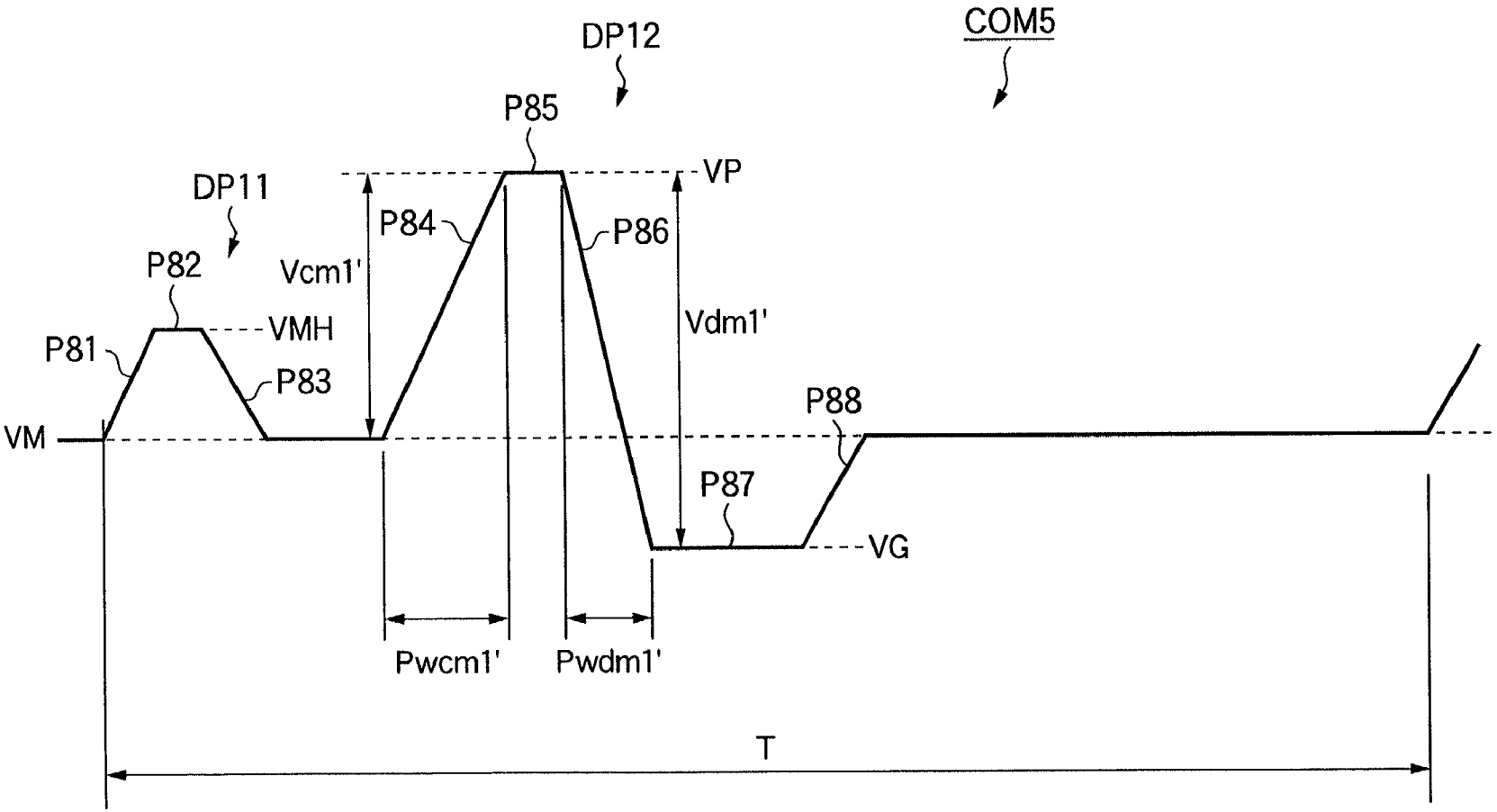
FIG. 22 is a view showing a drive signal according to a fifth embodiment of the invention.

A drive signal COM5 shown in FIG. 22 includes a vibrating pulse DP11 that vibrates the meniscus and a normal dot drive pulse DP12 that is generated after the vibrating pulse DP11 and ejects ink droplets through the nozzle orifices 16. These vibrating pulse DP11 and normal dot drive pulse DP12 are repeatedly generated in each of the printing cycles T.

And, with the drive signal COM5, any one of either the vibrating pulse DP11 or normal dot drive pulse DP12 is provided to the piezoelectric vibrator 2. That is, in the case where ink droplets are ejected, only the normal dot drive pulse DP12 is selected and is provided to the piezoelectric vibrator 2, and in the case where no ink droplets are elected, only the vibrating pulse DP11 is selected and is provided to the piezoelectric vibrator 2.

The vibrating pulse DP11 is a drive pulse to vibrates the meniscus of ink in the nozzle orifice 16. The vibrating pulse DP11 is composed of an expansion element P81 that raises the potential from the intermediate potential VM to the second intermediate potential, which is slightly higher than the intermediate potential VMH, at a relatively gentle potential gradient such an extent that no ink droplets are ejected; a holding element P82 that is generated continuously from the expansion element P81 and holds the second intermediate potential VHM for a predetermined time period; and a contraction element P83 that is generated continuously from the holding element P82 and lowers the potential from the second intermediate potential VMH to the intermediate potential VM at a relatively gentle potential gradient.

In addition, as the vibrating pulse DP11 is provided to the piezoelectric vibrator 2, the piezoelectric vibrator 2 and pressure chamber 17 operate as in the case where the vibrating pulses DP1, DP8, etc., are provided, wherein it is possible to prevent the ink viscosity from increasing in the vicinity of the nozzle orifices 16.

The normal dot drive pulse DP12 serves as the fourth drive pulse and the fifth drive pulse of the invention, and is composed of an expansion element P84 that raises the potential from the intermediate potential VM to the maximum potential VP at a fixed gradient such an extent that no ink droplets are ejected; a holding element P85 that is generated continuously from the expansion element P84 and holds the maximum potential VP for a predetermined time period; an ejection element P86 that is generated continuously from the holding element P85 and radically lowers the potential from the maximum potential VP to the minimum potential VG; a holding element P87 that is generated continuously from the ejection element P86 and holds the minimum potential VG for a predetermined time period; and a damping element P88 that is generated continuously from the holding element P87 and raises the potential from the minimum potential VG to the intermediate potential VM.

In the normal dot drive pulse DP12, the respective elements from the expansion element P84 through the damping element P88 correspond to the waveform elements of the invention. And, the expansion element P84 serves as the first expansion element of the invention, the holding element P85 serves as the first holding element thereof, and the ejection element P86 serves as the first ejection element thereof. That is, these expansion element P84, holding element P85 and ejection element P86 are waveform elements that relate to the pressure fluctuation in the pressure chamber 17 for the purpose of ejecting ink droplets, and serve as the characteristic changing elements.

The normal dot drive pulse DP12 is provided to the piezoelectric vibrator 2, the piezoelectric vibrator 2 and pressure chamber 17 operate as in the case where the above-described normal dot drive pulse DP2 is provided.

That is, the piezoelectric vibrator 2 largely contracts in accordance with the provision of the expansion element P84, wherein the pressure chamber 17 expands from its reference capacity to its maximum capacity. In accordance with the expansion, the pressure in the pressure chamber 17 is reduced. After that, the ejection element P86 is provided to cause the piezoelectric vibrator 2 to largely extend, wherein the pressure chamber 17 radically contracts to the minimum capacity. In accordance with the contraction, the ink in the pressure chamber 17 is pressurized to cause ink droplets to be ejected through the nozzle orifices 16. Since the holding element P87 is provided in succession with the ejection element P86, the contracted state of the pressure chamber 17 is held. After that, the damping element P88 is provided at the timing at which the vibrations of the meniscus can be counterbalanced, and the pressure chamber 17 expands and is reset to the reference capacity. That is, the pressure chamber 17 is caused to expand to reduce the ink pressure in order to counterbalance the ink pressure in the pressure chamber 17.

And, the controller 46 controls the drive signal generator 48 in accordance with the Tc rank, and varies the times Pwcm1', Pwdm1' of generation of the expansion element P84 and the ejection element P86, and potential differences Vcm1' and Vdm1'. That is, it is possible to vary expansion rate and expansion degree of the pressure chamber 17 by the expansion element P84 in accordance with the Tc ranks, and to vary contraction rate and contraction degree of the pressure chamber 17 by the ejection element P86.

For example, in connection with the expansion element P84, with regard to the recording heads 1 of maximum rank, the time Pwcm1' of generation is set to be longer than the time Pwcm1' of generation in the reference rank, and the potential difference Vcm1' is set to be larger than the potential difference Vcm1' in the reference rank. On the other hand, in regard to the recording heads 1' of minimum rank, the time Pwcm1' of generation is set to be shorter than the time Pwcm1' of generation in the reference rank, and the potential difference Vcm1' is set to be smaller than the potential difference Vcm1' in the reference rank.

Further, in connection with the ejection element P86, with regard to the recording heads 1 of maximum rank, the time Pwdm1' of generation is set to be longer than the time Pwdm1' of generation in the reference rank, and the potential difference Vdm1' is set to be larger than the potential difference Vdm1' in the reference rank. On the other hand; in regard to the recording heads 1' of minimum rank, the time Pwdm1' of generation is set to be shorter than the time Pwdm1' of generation in the reference rank, and the potential difference Vdm1' is set to be smaller than the potential difference Vdm1' in the reference rank.

Therefore, even if the natural period Tc is not even, it is possible to make the eject velocity of ink droplets uniform. Further, in this case, by varying at least one of the times Pwcm1' and Pwdm1' of generation and potential differences Vcm1' and Vdm1', it is possible to optimize the ink velocity.

In addition, the time duration of the holding element P85 may be varied in accordance with the Tc ranks by the controller 46 as in the case of the above-described middle dot drive pulse DP10, whereby the timing of causing the pressure chamber 17 to contract can be optimized, and it is possible to efficiently eject ink droplets.

Next, a description is given of a case where the present invention is applied to a recording apparatus having the recording head 70 employing the heating element 79 as the pressure generating element.

First, a description is given of an example in which control factors of the damping element are defined in accordance with the Tc ranks.

Figure 23:
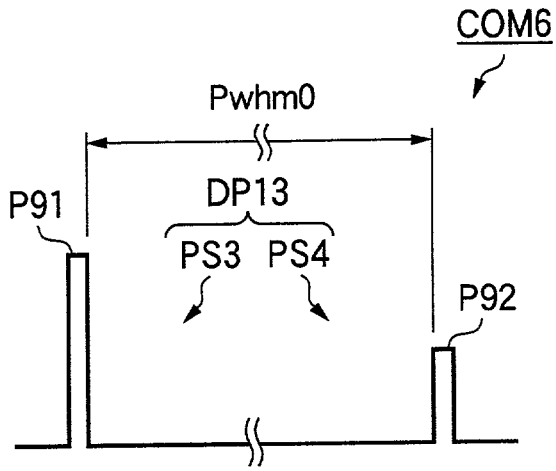
FIG. 23 is a view showing a drive signal according to a sixth embodiment of the invention.

A drive signal COM6 shown in FIG. 23 has a drive pulse DP13 consisting of an ejection pulse PS3 having an ejection element P91 and a damping pulse PS4 having a damping element P92. Either of these ejection pulse P3 or damping pulse PS4 is a rectangular pulse, wherein the drive voltage of the ejection pulse PS3 (that is, the potential difference between the minimum potential and the maximum potential) is set to be higher than the drive voltage of the damping pulse PS4.

And, in the drive pulse DP13, the time duration of the time Pwhm0 of generation is varied in accordance with the Tc ranks with respect to a connecting element P53 (corresponding to the first connecting element of the invention) that is generated between the ejection pulse PS3 and the damping pulse P84, whereby the drive pulse DP13 can bring about almost the same effect as that in the above-described example, and it is possible to efficiently suppress the vibrations of the meniscus.

Next, a description is given of an example in which control factors of the characteristic changing element are defined in accordance with the Tc ranks.

Figure 24:
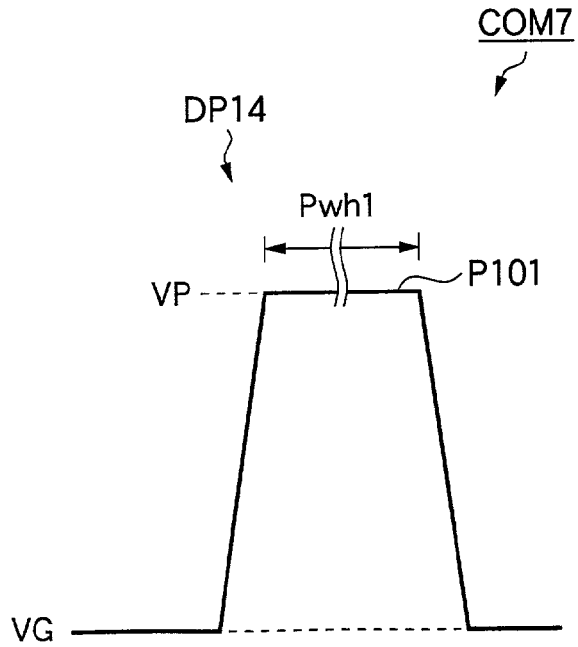
FIG. 24 is a view showing a drive signal according to a seventh embodiment of the invention.

A drive signal COM7 shown in FIG. 24 has a rectangular drive pulse having an ejection element P101.

And, in the drive pulse DP14, it is possible to optimize the velocity of ink droplets by varying at least one of the time Pwh1 of generation of the ejection element P101 and the drive voltage thereof.

As described above, in the respective embodiments described above, a Tc rank that is defined on the basis of the natural period of ink in the pressure chamber is given to a recording head 1 or 70. Simultaneously, control factors of waveform elements that constitute the drive signals COM are defined in accordance with the defined Tc rank with respect to each recording head, and a drive signal according to the established control factors is provided to the pressure generating element. Therefore, it is possible to set the waveform, etc., of the drive signal in accordance with the Tc ranks and optimize the waveform, etc., wherein it is possible to easily correct unevenness in image quality in each of the recording heads. Still further, in this case, since no separately exclusive waveform is used in each of the recording heads, differences in individual recording heads can be corrected in the process of production, wherein the production yield ratio can be improved. Therefore, the method for manufacturing an ink jet recording head, the ink jet recording head, the method for driving the ink jet recording head, and ink jet recording apparatus according to the invention are suitable for mass production.

As regards the Tc ranks, the reference rank in which the natural period Tc is as per the designed criterion, the minimum rank in which the natural period Tc is shorter than the designed criterion, and the maximum in which the natural period Tc is longer than the designed criterion are set. Assembled recording heads 1 are classified into these Tc ranks, wherein the same correction is carried out with respect to the recording head belonging the same Tc rank in order to establish a drive signal. Thus, efficiency is improved in the case of mass production, and optimization of image quality can be easily achieved.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, in the above-described embodiments, the example in which given Tc ranks are stored in the rank ID memory element 33 was explained. However, the present invention is not limited to this example.

That is, in the case where the given Tc ranks are marked in the rank indicator 32, as shown in FIG. 16, it is possible to cause the controller 46 to recognize the Tc ranks by employing a rank ID input device 60 such as a keyboard, touch panel, etc. Still further, the Tc ranks that are marked on the rank indicator 32 may be read by a rank ID reader 61 (corresponding to the optical reader of the invention) such as a scanner, line sensor, etc. In this case, when setting a drive waveform suited to the recording heads 1, work of reading the Tc ranks can be automated, wherein the work efficiency can be further improved.

What is claimed is:

1. A method of manufacturing an ink jet recording head which includes a plurality of nozzle orifices forming at least one nozzle row, pressure chambers each communicated with the associated nozzle orifice, pressure generating elements each generating pressure fluctuation in ink provided in the associated pressure chamber to eject an ink droplet from the associated nozzle orifice, the method comprising the steps of:

assembling the ink jet recording head;

executing a plurality of ink droplet ejections from the nozzle orifice, while varying an ejecting time duration as ejecting conditions to measure either corresponding ejected amounts of ink droplets or corresponding ejected speeds as ejecting results;

identifying a correlation between the ejecting conditions and the ejecting results based on the plurality of ink droplet ejections; and classifying the assembled recording head into a plurality of ranks, based on the identified correlation.

2. The manufacturing method as set forth in claim 1, wherein the step of executing the ink droplet ejections includes the steps of:

supplying an evaluation signal including at least an excitation element which excites the ink pressure fluctuation, and an ejection element which follows the excitation element to eject the ink droplet from the nozzle orifice; and measuring the ejected amounts as the ejecting results while varying a time period between a termination end of the excitation element and an initial end of the ejection element as the ejecting conditions.

3. The manufacturing method as set forth in claim 2, wherein the time period includes at least:

a first time period which is determined such that the ejected ink amount becomes minimum when a natural period is as per a designed criterion;

a second time period which is shorter than the first time period; and a third time period which is longer than the first time period.

4. The manufacturing method as set forth in claim 2, wherein duration of the excitation element is equal to a natural period as per a designed criterion or less.

5. The manufacturing method as set forth in claim 1, wherein the duration of the excitation element is equal to one half of a natural period as per the designed criterion or less.

6. The manufacturing method as set forth in claim 1, wherein the step of executing the ink droplet ejections includes the steps of:

supplying an evaluation signal including at least an excitation element which excites the ink pressure fluctuation, and an ejection element which follows the excitation element to eject the ink droplet from the nozzle orifice; and measuring the ejected speeds while as the ejecting results varying a time period between a termination end of the excitation element and an initial end of the ejection element.

7. The manufacturing method as set forth in claim 6, wherein the time period includes at least:

a first time period which is determined such that the ejection speed becomes minimum when a natural period is as per a designed criterion;

a second time period which is shorter than the first time period; and a third time period which is longer than the first time period.

8. The manufacturing method as set forth in claim 6, wherein duration of the excitation element is equal to a natural period as per the designed criterion or less.

9. The manufacturing method as set forth in claim 8, wherein the duration of the excitation element is equal to one half of a natural period as per the designed criterion or less.

10. The manufacturing method as set forth in claim 1, wherein the plurality of ranks includes at least a first rank which indicates an actual natural period is as per a designed criterion, a second rank which indicates the actual natural period is shorter than the designed criterion, a third rank which indicates the actual natural period is longer than the designed criterion, and a fourth rank which indicates an erroneous condition.

11. The manufacturing method as set forth in claim 1, further comprising the step of indicating the classified rank on the assembled recording head.

12. The manufacturing method as set forth in claim 11, wherein the classified rank is indicated by a symbol.

13. The manufacturing method as set forth in claim 11, wherein the rank is determined with regard to the respective nozzle rows; and wherein the rank is indicated by a symbol which indicates a combination of the classified ranks of the respective nozzle rows.

14. The manufacturing method as set forth in claim 11, wherein the classified rank is indicated by coded information which is readable by an optical reader.

15. The manufacturing method as set forth in claim 1, further comprising the steps of:

providing a memory; and storing electrically information indicating the classified rank in the memory.

16. A method of driving the ink jet recording head comprising the steps of:

providing a rank indicator which indicates one of the ranks classified in the method as set forth in claim 1;

providing a drive signal including at least one wave element having a control factor which is defined in accordance with the rank indicated by the rank indicator; and supplying the drive signal to the pressure generating element.

17. The driving method as set forth in claim 16, wherein the drive signal is provided with an ejection element which ejects an ink droplet from the nozzle orifice and a damping element which follows the ejection element to damp vibration of a meniscus of the ink in the nozzle orifice; and wherein a control factor of the damping element is defined in the drive signal provision step.

18. The driving method as set forth in claim 16, wherein the drive signal is provided with a characteristics changing element which changes ejection characteristics of the ink droplet; and wherein a control factor of the characteristics changing element is defined in the drive signal provision step.

19. The driving method as set forth in claim 16, wherein the plurality of ranks includes at least a first rank which indicates an actual natural period is as per a designed criterion, a second rank which indicates the actual natural period is shorter than the designed criterion, a third rank which indicates the actual natural period is longer than the designed criterion, and a fourth rank which indicates an erroneous condition.

20. An ink jet recording apparatus, comprising:

an ink jet recording head, comprising a rank indicator which indicates one of the ranks classified by the method as set forth in claim 1; and a waveform controller, which provides a drive signal including at least one wave element having a control factor which is defined in accordance with the classified rank.

21. The recording apparatus as set forth in claim 20, wherein the drive signal is provided with an ejection element which ejects an ink droplet from the nozzle orifice and a damping element which follows the ejection element to damp vibration of a meniscus of the ink in the nozzle orifice; and wherein the waveform controller defines a control factor of the damping element.

22. The recording apparatus as set forth in claim 17, wherein the drive signal is provided with a drive pulse including:

an expansion element, which expands the pressure chamber such an extent that an ink droplet is not ejected from the nozzle orifice;

an ejection element, which follows the expansion element to contract the pressure chamber to eject an ink droplet from the nozzle orifice;

a holding element, which follows the ejection element to hold the contracted state of the pressure chamber for a predetermined duration; and damping element, which follows the holding element to expand the pressure chamber to damp vibration of a meniscus of the ink in the nozzle orifice; and wherein the waveform controller defines the duration of the holding element.

23. The recording apparatus as set forth in claim 20, wherein the drive signal is provided with a drive pulse including:

an expansion element, which expands the pressure chamber to pull a meniscus of ink in the nozzle orifice toward the pressure chamber;

an ejection element, which follows the expansion element to contract the pressure chamber to eject a center portion of the meniscus as an ink droplet; and a damping element, which follows the ejection element to expand the pressure chamber to damp vibration of the meniscus; and wherein the waveform controller defines the duration of the damping element.

24. The recording apparatus as set forth in claim 20, wherein the drive signal is provided with a drive pulse including:

an ejection pulse, which ejects an ink droplet from the nozzle orifice;

a damping pulse, which follows the ejection pulse to damp vibration of a meniscus of ink in the nozzle orifice; and a connecting element, which connects a termination end of the ejection pulse and an initial end of the damping pulse; and wherein the waveform controller defines duration of the connecting element.

25. The recording apparatus as set forth in claim 20, wherein the drive signal is provided with a plurality of drive pulses for driving the pressure generating element and a connecting element which connects a termination end of a preceding drive pulse and an initial end of a subsequent drive pulse; and wherein the waveform controller defines duration of the second connecting element.

26. The recording apparatus as set forth in claim 20, wherein the drive signal is provided with a characteristics changing element which changes ejection characteristics of an ink droplet; and wherein the waveform controller defines a control factor of the characteristics changing element.

27. The recording apparatus as set forth in claim 26, wherein the drive signal is provided with a drive pulse including:

an expansion element, which expands the pressure chamber such an extent that an ink droplet is not ejected; and an ejection element, which follows the expansion element to contract the pressure chamber to eject an ink droplet from the nozzle orifice; and wherein duration of at least one of the first expansion element and the first ejection element is defined by the waveform controller.

28. The recording apparatus as set forth in claim 26, wherein the drive signal is provided with a drive pulse including:

an expansion element, which expands the pressure chamber such an extent that an ink droplet is not ejected; and an ejection element, which follows the expansion element to contract the pressure chamber to eject an ink droplet from the nozzle orifice; and wherein a potential difference between an initial end and a termination end of at least one of the expansion element and the ejection element is defined by the waveform controller.

29. The recording apparatus as set forth in claim 26, wherein the drive signal is provided with a drive pulse including:

an expansion element, which expands the pressure chamber such an extent that an ink droplet is not ejected;

a holding element, which follows the expansion element to hold the expanded state of the pressure chamber; and an ejection element, which follows the expansion element to contract the pressure chamber to eject an ink droplet from the nozzle orifice; and wherein the waveform controller defines duration of the holding element.

30. The recording apparatus as set forth in claim 23, wherein the drive signal is provided with a pulse including:

an expansion element, which expands the pressure chamber to pull a meniscus of ink in the nozzle orifice toward the pressure chamber; and an ejection element, which follows the expansion element to contract the pressure chamber to eject a center portion of the meniscus as an ink droplet; and wherein duration of at least one of the expansion element and the ejection element is defined by the waveform controller.

31. The recording apparatus as set forth in claim 26, wherein the drive signal is provided with a drive pulse including:

an expansion element, which expands the pressure chamber to pull a meniscus of ink in the nozzle orifice toward the pressure chamber; and an ejection element, which follows the expansion element to contract the pressure chamber to eject a center portion of the meniscus as an ink droplet; and wherein a potential difference between an initial end and a termination end of at least one of the expansion element and the ejection element is defined by the waveform controller.

32. The recording apparatus as set forth in claim 26, wherein the drive signal is provided with a drive pulse including:

an expansion element, which expands the pressure chamber to pull a meniscus of ink in the nozzle orifice toward the pressure chamber;

a holding element, which follows the expansion element to hold the expanded state of the pressure chamber; and an ejection element, which follows the holding element to contract the pressure chamber to eject a center portion of the meniscus as an ink droplet; and wherein the waveform controller defines duration of the holding element.

33. The recording apparatus as set forth in claim 20, further comprising: a memory, which electrically stores information indicating the classified rank, the memory electrically connected to the waveform controller.

34. The recording apparatus as set forth in claim 20, further comprising:

a rank indicator, provided with the recording head to indicate the classified rank thereof so as to be optically readable; and an optical reader, which optically reads the classified rank indicated by the rank indicator, wherein the waveform controller acquires the classified rank read by the optical reader.

35. The recording apparatus as set forth in claim 20, wherein the pressure generating element is a piezoelectric vibrator.

36. The recording apparatus as set forth in claim 20, wherein the pressure generating element is a heating element.

37. An ink jet recording head, comprising a rank indicator, which indicates one of the ranks classified by the method as set forth in claim 1.

38. The recording head as set forth in claim 37, wherein the pressure generating element is a piezoelectric vibrator.

39. The recording apparatus as set forth in claim 37, wherein the pressure generating element is a heating element.

40. The ink jet recording head as set forth in claim 37, wherein the classified rank is indicated by a symbol.

41. The ink jet recording head as set forth in claim 37, further comprising a plurality of nozzle rows;

wherein the rank is determined with regard to the nozzle rows; and wherein the rank is indicated by a symbol which indicates a combination of the classified ranks of the nozzle rows.

42. The ink jet recording head as set forth in claim 37, wherein the classified rank is indicated by coded information which is readable by an optical reader.

43. The ink jet recording head as set forth in claim 37, further comprising a memory which electrically stores information indicating the classified rank.

44. The manufacturing method as set forth in claim 1, wherein at least one of the ranks is associated with a plurality of correlations.

* * * * *